US010047713B2

(12) United States Patent
Noguchi

(10) Patent No.: US 10,047,713 B2
(45) Date of Patent: Aug. 14, 2018

(54) ATTACHMENT STRUCTURE OF FUEL INJECTION DEVICE NOZZLE PLATE

(71) Applicant: Enplas Corporation, Saitama (JP)

(72) Inventor: Koji Noguchi, Saitama (JP)

(73) Assignee: Enplas Corporation, Saitama (JP)

( * ) Notice: Subject to any disclaimer, the term of this patent is extended or adjusted under 35 U.S.C. 154(b) by 2 days.

(21) Appl. No.: 15/032,173

(22) PCT Filed: Oct. 8, 2014

(86) PCT No.: PCT/JP2014/076903
§ 371 (c)(1),
(2) Date: Apr. 26, 2016

(87) PCT Pub. No.: WO2015/068516
PCT Pub. Date: May 14, 2015

(65) Prior Publication Data

US 2016/0258408 A1 Sep. 8, 2016

(30) Foreign Application Priority Data

Nov. 11, 2013 (JP) ..... 2013-232653
Nov. 19, 2013 (JP) ..... 2013-239092

(51) Int. Cl.
*F02M 51/06* (2006.01)
*F02M 51/08* (2006.01)
(Continued)

(52) U.S. Cl.
CPC .... *F02M 61/1853* (2013.01); *F02M 61/1893* (2013.01); *F02M 69/044* (2013.01);
(Continued)

(58) Field of Classification Search
CPC ..... F02M 61/1853; F02M 61/1893; F02M 69/044; F02M 2051/08; F02M 2200/8053; F02M 51/06; F02M 69/043
(Continued)

(56) References Cited

U.S. PATENT DOCUMENTS 4,628,576 A * 12/1986 Giachino ..... B41J 2/17596 239/102.1
5,174,505 A * 12/1992 Shen ..... F02M 51/0671 123/531
(Continued)

FOREIGN PATENT DOCUMENTS

JP 1-173372 12/1989
JP 7-151037 6/1995
(Continued)

OTHER PUBLICATIONS

International Search Report dated Dec. 9, 2014 in corresponding International Application No. PCT/JP2014/076903 (with English translation).

*Primary Examiner* — Darren W Gorman
*Assistant Examiner* — Joseph A Greenlund
(74) *Attorney, Agent, or Firm* — Wenderoth, Lind & Ponack, L.L.P.

(57) ABSTRACT

A metal valve body having a fuel injection port includes a nozzle plate accommodation part accommodating a nozzle plate of synthetic resin and aligning a center of the nozzle plate with a central axis of the valve body. A front end surface abutting against the nozzle plate is accommodated in the nozzle plate accommodation part. A swage projection fixes the nozzle plate to the front end side on which the fuel injection port is formed. The nozzle plate is swage-fixed in the state in which a spring action part is elastically deformed on the front end side of the valve body by the swage projection, and a nozzle hole formation part is constantly
(Continued)

pushed against the front end surface of the valve body by the elastic force of the spring action part.

6 Claims, 33 Drawing Sheets

(51) Int. Cl.
*F02M 61/18* (2006.01)
*F02M 69/04* (2006.01)

(52) U.S. Cl.
CPC ..... *F02M 51/06* (2013.01); *F02M 69/043* (2013.01); *F02M 2051/08* (2013.01); *F02M 2200/8053* (2013.01)

(58) Field of Classification Search
USPC ..... 239/533.14, 596
See application file for complete search history.

(56) References Cited

U.S. PATENT DOCUMENTS 5,435,884 A * 7/1995 Simmons ..... B05B 1/3436 216/100
5,437,413 A * 8/1995 Shen ..... F02M 61/1853 239/424.5
5,540,387 A * 7/1996 Reiter ..... F02M 51/0682 239/408
5,881,957 A 3/1999 Mizuno et al.
6,170,764 B1 * 1/2001 Muller ..... F02M 61/162 239/491
6,230,992 B1 * 5/2001 Arndt ..... B05B 7/0815 239/424.5
6,669,116 B2 * 12/2003 Iwase ..... F02M 51/0671 239/533.12
6,814,312 B2 * 11/2004 Iwano ..... F02M 51/0682 239/533.12
7,571,868 B2 * 8/2009 Bayer ..... F02M 51/0685 239/552
7,931,212 B2 * 4/2011 Urich ..... B05B 17/0646 239/102.1
8,231,069 B2 * 7/2012 Matsumura ..... F02M 61/1853 239/518
2003/0111559 A1 * 6/2003 Muller-Girard, Jr. ..... F02M 51/0639 239/533.3
2003/0121999 A1 * 7/2003 Huebel ..... F02M 51/0671 239/585.1
2004/0046063 A1 * 3/2004 Heyse ..... F02M 51/0671 239/533.12
2004/0056120 A1 * 3/2004 Wieczorek ..... F02M 51/0625 239/533.12
2009/0200402 A1 * 8/2009 Gesk ..... F02M 61/1853 239/533.12
2009/0206181 A1 * 8/2009 Arndt ..... F02M 61/1833 239/533.12
2013/0175367 A1 * 7/2013 Okamoto ..... F02M 51/0664 239/463
2013/0256428 A1 * 10/2013 Okamoto ..... F02M 61/162 239/463
2013/0327855 A1 * 12/2013 Mosser ..... F02M 61/1833 239/601
2016/0237968 A1 * 8/2016 Noguchi ..... F02M 61/168
2016/0258408 A1 * 9/2016 Noguchi ..... F02M 61/1893

FOREIGN PATENT DOCUMENTS

JP 9-317607 12/1997
JP 11-270438 10/1999
JP 2003-232271 8/2003
JP 2011-144731 7/2011
JP 2013-96237 5/2013

* cited by examiner

ATTACHMENT STRUCTURE OF FUEL INJECTION DEVICE NOZZLE PLATE

BACKGROUND OF THE INVENTION

Technical Field

The present invention relates to an attachment structure of a fuel injection device nozzle plate (abbreviated below as "nozzle plate" as appropriate) used to atomize and inject fuel flowing from a fuel injection port of a fuel injection device.

Background Art

An internal combustion engine (abbreviated below as "engine") of an automobile or the like mixes fuel injected from a fuel injection device and air introduced via an intake air pipe to generate a combustible gas mixture, and burns the combustible gas mixture in the cylinder. It is known that the mixture state of fuel injected from the fuel injection device and air significantly affects the performance of this type of engine and, in particular, the atomization of fuel injected from the fuel injection device is an important factor governing the performance of the engine.

Accordingly, as illustrated in FIG. 33, a conventional fuel injection device 1000 promotes the atomization of fuel by welding a nozzle plate 1003 of metal to a valve body 1002 of metal having a fuel injection port 1001 and injecting the fuel injected from the fuel injection port 1001 into an intake air pipe via nozzle holes 1004 formed in the nozzle plate 1003 (see JP-A-11-270438 and JP-A-2011-144731).

However, the conventional fuel injection device 1000 needs to use a masking jig for welding to prevent welding spatter from entering the nozzle holes 1004 of the nozzle plate 1003 and blocking the nozzle holes 1004, so efficient welding is difficult. As a result, the manufacturing man-hours of the conventional fuel injection device 1000 increase, making it difficult to reduce the manufacturing cost.

SUMMARY OF THE INVENTION

An object of the invention is to provide the attachment structure of a fuel injection device nozzle plate for enabling reduction in the manufacturing man-hours and manufacturing cost of a fuel injection device.

As illustrated in FIGS. 1 to 28, a first aspect relates to an attachment structure of fuel injection device nozzle plates 3 and 103 having nozzle holes 7 and 107 for atomizing and injecting fuel flowing from fuel injection ports 4 and 104 of fuel injection devices 1 and 101. In the aspect, metal valve bodies 5 and 105 having the fuel injection ports 4 and 104 on front end sides include nozzle plate accommodation parts 8 and 108 accommodating the fuel injection device nozzle plates 3 and 103 of synthetic resin, nozzle plate supporting parts (front end surfaces 10 and 110) supporting the fuel injection device nozzle plates 3 and 103 accommodated in the nozzle plate accommodation parts 8 and 108, and nozzle plate fixation parts (15, 32, 37, 41, and 113) fixing the fuel injection device nozzle plates 3 and 103 to the front end sides on which the fuel injection ports 4 and 104 are formed. In addition, the fuel injection device nozzle plates 3 and 103 include nozzle hole formation parts 18 and 116 in which the nozzle holes 7 and 107 are formed and spring action parts 16, 117, and 133 fixed to the front end sides of the valve bodies 5 and 105 by the nozzle plate fixation parts while being elastically deformed. In addition, the spring action parts 16, 117, and 133 constantly push the nozzle hole formation parts 18 and 116 against the nozzle plate supporting parts (the front end surfaces 10 and 110) of the valve bodies 5 and 105 when the spring action parts 16, 117, and 133 are fixed to the front end sides of the valve bodies 5 and 105 by the nozzle plate fixation parts while being elastically deformed.

As illustrated in FIGS. 1 to 21, a second aspect relates to an attachment structure of a fuel injection device nozzle plate 3 having a nozzle hole 7 for atomizing and injecting fuel flowing from a fuel injection port 4 of a fuel injection device 1. In the aspect, a metal valve body 5 having the fuel injection port 4 includes a nozzle plate accommodation part 8 accommodating the fuel injection device nozzle plate 3 of synthetic resin and aligning a center 22 of the fuel injection device nozzle plate 3 with a central axis 11 of the valve body 5, a nozzle plate supporting part (a front end surface 10) abutting against the fuel injection device nozzle plate 3 accommodated in the nozzle plate accommodation part 8, and swage parts (swage projections 15, 32, and 37 and an annular projection 41) fixing the fuel injection nozzle plate 3 to the front end side on which the fuel injection port 4 is formed. In addition, the fuel injection device nozzle plate 3 includes a nozzle hole formation part 18 in which the nozzle hole 7 is formed and a spring action part 16 swage-fixed to the front end side of the valve body 5 while being elastically deformed since the swage parts (the swage projections 15, 32, and 37 and the annular projection 41) are plastically deformed. The spring action part 16 constantly pushes the nozzle hole formation part 18 against the nozzle plate supporting part (the front end surface 10) of the valve body 5 when the spring action part 16 is fixed to the front end side of the valve body 5 by the swage parts (swage projections 15, 32, and 37 and the annular projection 41) while being elastically deformed.

As illustrated in FIGS. 22 to 28, a third aspect relates to an attachment structure of a fuel injection device nozzle plate 103 having a nozzle hole 107 for atomizing and injecting fuel flowing from a fuel injection port 104 of a fuel injection device 101. In the aspect, a metal valve body 105 having the fuel injection port 104 on a front end side includes a cylindrical nozzle plate accommodation part 108 accommodating the fuel injection device nozzle plate 103 of synthetic resin, and a nozzle plate supporting part (front end surface 110) supporting the fuel injection device nozzle plate 103 accommodated in the nozzle plate accommodation part 108 using the front end side on which the fuel injection port 104 is formed. In addition, the nozzle plate accommodation part 108 has, on a part of an inner peripheral surface 112 close to an opening end, a removal prevention projection 113 preventing the fuel injection device nozzle plate 103 accommodated in the nozzle plate accommodation part 108 from being removed so that the removal prevention projection 113 is hooked on the fuel injection device nozzle plate 103. In addition, the fuel injection device nozzle plate 103 includes a nozzle hole formation part 116 in which the nozzle hole 107 is formed and a plurality of spring action parts 117 and 133 formed radially outward of the nozzle hole formation part 116. In addition, the spring action parts 117 and 133 are elastically deformed in a diameter reducing direction by the removal prevention projection 113 when the fuel injection nozzle plate 103 is accommodated in the nozzle plate accommodation part 108 to enable the fuel injection nozzle plate 103 to pass radially inward of the removal prevention projection 113, elastically restored in a diameter increasing direction and makes contact with an inner peripheral surface 112 of the nozzle plate accommodation part 108 when the fuel injection nozzle plate 103 is accommodated in the nozzle plate accommodation part 108, aligns a center 124 of the fuel injection device nozzle plate 103 with a central axis 111 of the valve body 105, is bent by the removal prevention projection 113, and pushes the nozzle hole formation part 116 against the nozzle plate supporting part (front end surface) 110.

Advantageous Effects of Invention

In the first aspect, the fuel injection device nozzle plate is fixed to the front end side of the valve body by the nozzle plate fixation part, which is a part of the valve body. Accordingly, the first aspect can reduce the manufacturing man-hours and manufacturing cost of the fuel injection device as compared with a conventional example in which the nozzle plate of metal is fixed to the front end of the valve body of metal by welding.

In addition, in the first aspect, the fuel injection device nozzle plate has the spring action part fixed to the front end side of the valve body by the nozzle plate fixation part, which is a part of the valve body, while being elastically deformed. The fuel injection device nozzle plate is constantly pushed against the nozzle plate supporting part of the valve body by the elastic force of the spring action part. Accordingly, in the first aspect, the manufacturing error of the fuel injection device nozzle plate and the valve body can be absorbed by the elastic deformation of the spring action part, the difference in thermal expansion between the fuel injection device nozzle plate and the valve body can be absorbed by the elastic deformation of the spring action part, and the fuel injection device nozzle plate can be surely fixed to the front end side of the valve body.

In addition, in the second aspect, the fuel injection device nozzle plate is fixed to the front end side of the valve body by plastically deforming the swage part of the valve body. Accordingly, the second aspect can reduce the manufacturing man-hours and manufacturing cost of the fuel injection device as compared with the conventional example in which the nozzle plate of metal is fixed to the front end of the valve body of metal by welding.

In addition, in the second aspect, the fuel injection device nozzle plate has the spring action part fixed to the front end side of the valve body by the swage part of the valve body while being elastically deformed, and the fuel injection device nozzle plate is constantly pushed against the nozzle plate supporting part of the valve body by the elastic force of the spring action part. Accordingly, in the second aspect, the manufacturing error of the fuel injection device nozzle plate and the valve body can be absorbed by the elastic deformation of the spring action part, the difference in thermal expansion between the fuel injection device nozzle plate and the valve body can be absorbed by the elastic deformation of the spring action part, and the fuel injection device nozzle plate can be surely fixed to the front end side of the valve body.

In addition, in the third aspect, the fuel injection device nozzle plate is fixed to the front end side of the valve body by the removal prevention projection only if the fuel injection device nozzle plate is pushed into the nozzle plate accommodation part of the valve body. Accordingly, the third aspect can reduce the manufacturing man-hours and manufacturing cost of the fuel injection device as compared with the conventional example in which the nozzle plate of metal is fixed to the front end of the valve body of metal by welding.

In addition, in the third aspect, when the fuel injection device nozzle plate is accommodated in the nozzle plate accommodation part of the valve body, the spring action part is fixed by the removal prevention projection while being elastically deformed and the nozzle hole formation part is pushed against the nozzle plate supporting part of the valve body by the elastic force of the spring action part. Accordingly, in the third aspect, the assembly error of the fuel injection device nozzle plate and the valve body can be absorbed by the elastic deformation of the spring action part, the difference in thermal expansion between the fuel injection device nozzle plate and the valve body can be absorbed by the elastic deformation of the spring action part, and the fuel injection device nozzle plate can be surely fixed to the front end side of the valve body.

BRIEF DESCRIPTION OF THE DRAWINGS

FIG. 2A is a front view illustrating the front end side of a fuel injection device, FIG. 2B is a side view illustrating the front end side of the fuel injection device seen from the direction indicated by arrow C1 in FIG. 2A, FIG. 2C is a cross sectional view illustrating the front end side of the fuel injection device taken along line A1-A1 in FIG. 2A, and FIG. 2D is an enlarged view of part D1 in FIG. 2C.

FIG. 3A is a front view illustrating the relationship between the front end side of the valve body and the nozzle plate, FIG. 3B is a side view illustrating the relationship between the front end side of the valve body and the nozzle plate seen from the direction indicated by arrow C2 in FIG. 3A, and FIG. 3C is a side view partially taken along line A2-A2 in FIG. 3A.

FIG. 4A is a front view illustrating the valve body, FIG. 4B is a side view illustrating the valve body seen from the direction indicated by arrow C3 in FIG. 4A, and FIG. 4C is a side view illustrating the valve body partially taken along line A3-A3 in FIG. 4A.

FIG. 5A is a front view illustrating the nozzle plate, FIG. 5B is a side view illustrating the nozzle plate seen from the direction indicated by arrow C4 in FIG. 5A, and FIG. 5C is a cross sectional view illustrating the nozzle plate taken along line A4-A4 in FIG. 5A.

FIG. 6A is a front view illustrating the front end side of a fuel injection device, FIG. 6B is a side view illustrating the valve body in FIG. 6A seen from the direction indicated by arrow C5, FIG. 6C is a side view partially taken along line A5-A5 in FIG. 6A, and FIG. 6D is an enlarged view illustrating part D2 in FIG. 6C.

FIG. 7A is a front view illustrating the relationship between the front end side of the valve body and the nozzle plate, FIG. 7B is a side view illustrating the relationship between the front end side of the valve body and the nozzle plate seen from the direction indicated by arrow C6 in FIG. 7A, and FIG. 7C is a side view partially taken along line A6-A6 in FIG. 7A.

FIG. 8A is a front view illustrating the front end side of a fuel injection device, FIG. 8B is a side view illustrating the front end side of the fuel injection device partially taken along line A7-A7 in FIG. 8A, and FIG. 8C is an enlarged view of part D3 in FIG. 8B.

FIG. 9A is a front view illustrating the relationship between the front end side of the valve body and the nozzle plate, and FIG. 9B is a side view partially taken along line A8-A8 in FIG. 9A.

FIG. 10A is a front view illustrating the valve body and FIG. 10B is a side view illustrating the valve body partially taken along line A9-A9 in FIG. 10A.

FIG. 11A is a front view illustrating the nozzle plate, FIG. 11B is a side view illustrating the nozzle plate, and FIG. 11C is a cross sectional view illustrating the nozzle plate taken along line A10-A10 in FIG. 11A.

FIG. 12A is a front view illustrating the front end side of a fuel injection device, FIG. 12B is a side view illustrating the front end side of the fuel injection device partially taken along line A11-A11 in FIG. 12A, and FIG. 12C is an enlarged view of part D4 in FIG. 12B.

FIG. 13A is a front view illustrating the front end side of a fuel injection device, FIG. 13B is a side view illustrating the front end side of the fuel injection device partially taken along line A12-A12 in FIG. 13A, and FIG. 13C is an enlarged view of part D5 in FIG. 13B.

FIG. 14A is a front view illustrating the relationship between the front end side of the valve body and the nozzle plate and FIG. 14B is a side view partially taken along line A13-A13 in FIG. 14A.

FIG. 15A is a front view illustrating the valve body and FIG. 15B is a side view illustrating the valve body partially taken along line A14-A14 in FIG. 15A.

FIG. 16A is a front view illustrating the nozzle plate, FIG. 16B is a side view illustrating the nozzle plate, and FIG. 16C is a cross sectional view illustrating the nozzle plate taken along line A15-A15 in FIG. 16A.

FIG. 17A is a front view illustrating the relationship between the front end side of the valve body and the nozzle plate, and FIG. 17B is a side view partially taken along line A16-A16 in FIG. 17A.

FIG. 18A is a front view illustrating the front end side of a fuel injection device, FIG. 18B is a side view illustrating the front end side of the fuel injection device partially taken along line A17-A17 in FIG. 18A, and FIG. 18C is an enlarged view of part D6 in FIG. 18B.

FIG. 19A is a front view illustrating the relationship between the front end side of the valve body and a nozzle plate and FIG. 19B is a side view partially taken along line A18-A18 in FIG. 19A.

FIG. 20A is a front view illustrating the relationship between the front end side of the valve body and the nozzle plate and FIG. 20B is a side view partially taken along line A19-A19 in FIG. 20A.

FIG. 21A is a front view illustrating the front end side of a fuel injection device, FIG. 21B is a side view illustrating the front end side of the fuel injection device partially taken along line A20-A20 in FIG. 21A, and FIG. 21C is an enlarged view illustrating part D7 in FIG. 21B.

FIG. 23A is a front view illustrating the front end side of a fuel injection device and FIG. 23B is a cross sectional view illustrating the front end side of the fuel injection device taken along line A21-A21 in FIG. 23A.

FIG. 24A is a front view illustrating the front end side of the valve body, FIG. 24B is a side view illustrating the front end side of the valve body, and FIG. 24C is a cross sectional view illustrating the front end side of the valve body taken along line A22-A22 in FIG. 24A.

FIG. 25A is a front view illustrating the nozzle plate, FIG. 25B is a cross sectional view illustrating the nozzle plate taken along line A23-A23 in FIG. 25A, and FIG. 25C is a back view illustrating the nozzle plate.

FIG. 26A is a front view illustrating the front end side of a fuel injection device and FIG. 26B is a cross sectional view illustrating the front end side of the fuel injection device taken along line A24-A24 in FIG. 26A.

FIG. 27A is a front view illustrating the front end side of the valve body, FIG. 27B is a side view illustrating the front end side of the valve body, and FIG. 27C is a cross sectional view illustrating the front end side of the valve body taken along line A25-A25 in FIG. 27A.

FIG. 28A is a front view illustrating the nozzle plate, FIG. 28B is a cross sectional view illustrating the nozzle plate taken along line A26-A26 in FIG. 28A, and FIG. 28C is a back view illustrating the nozzle plate.

FIG. 30A is a front view illustrating the nozzle plate and FIG. 30B is a side view illustrating a part of the nozzle plate seen from the direction indicated by C7 in FIG. 30A.

DETAILED DESCRIPTION OF THE INVENTION

Embodiments of the invention will be described below in detail with reference to the drawings.

First Embodiment (Fuel Injection Device)

Figure 1:
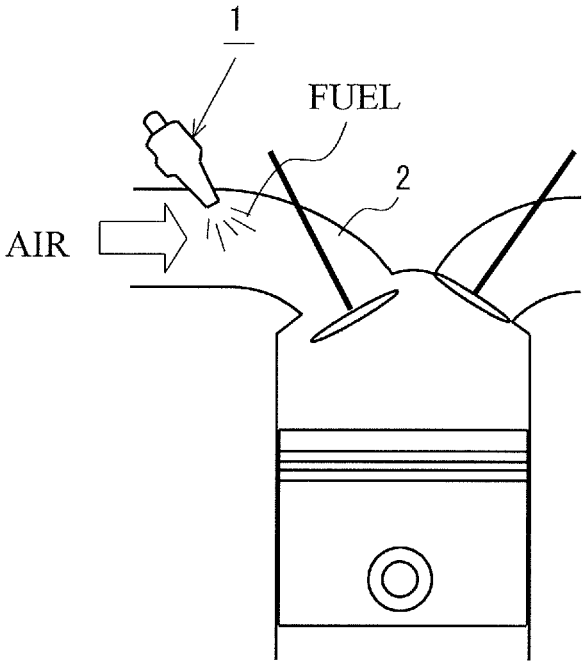
FIG. 1 schematically illustrates the use state of a fuel injection device.

FIG. 1 schematically illustrates the use state of a fuel injection device 1 (see FIG. 2). As illustrated in FIG. 1, the fuel injection device 1 of port injection type is installed at an intermediate point on an intake air pipe 2 of an engine, injects fuel into the intake air pipe 2, mixes air introduced to the intake air pipe 2 and the fuel, and generates a combustible gas mixture.

Figure 2A:
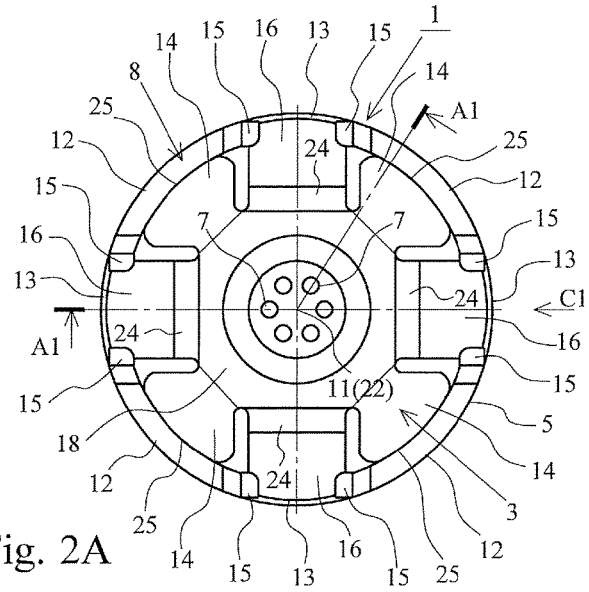
FIGS. 2A-2D illustrate an attachment structure of a nozzle plate according to a first embodiment of the invention. In particular.
Figure 2B:
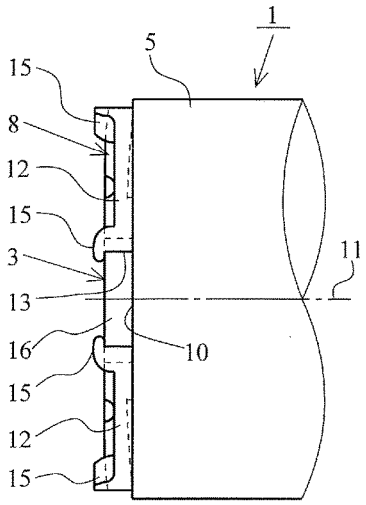
Figure 2C:
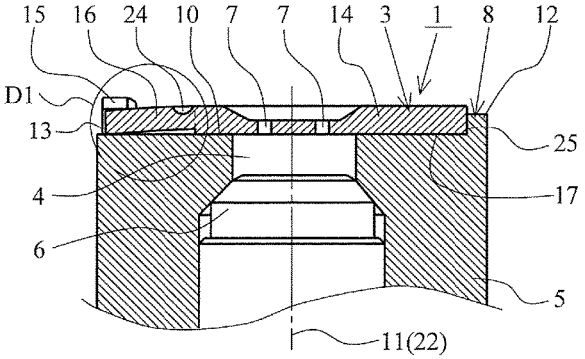

FIGS. 2A-2C illustrate the front end side of the fuel injection device 1 to which a fuel injection device nozzle plate 3 (abbreviated below as the nozzle plate) has been attached.

As illustrated in FIGS. 2A-2C, the fuel injection device 1 has the nozzle plate 3 of synthetic resin on the front end side of a valve body 5 of metal in which a fuel injection port 4 is formed. The fuel injection device 1 has a needle valve 6 opened or closed by a solenoid (not illustrated). When the needle valve 6 is opened, fuel in the valve body 5 is injected from the fuel injection port 4, and the fuel injected from the fuel injection port 4 is injected externally via nozzle holes 7 of the nozzle plate 3. The nozzle plate 3 is injection-molded using synthetic resin such as PPS, PEEK, POM, PA, PES, PEI, or LCP.

(Attachment Structure of Nozzle Plate)

An attachment structure of the nozzle plate 3 according to the embodiment will be described with reference to FIGS. 2A to 5C.

As illustrated in FIGS. 2A to 4C, the valve body 5 is circular in front view and has a nozzle plate accommodation part 8 for accommodating the nozzle plate 3 on the front end side. The nozzle plate accommodation part 8 has four arc-shaped walls 12 arranged in four positions at regular intervals about a central axis 11 of the valve body 5 and around the outer peripheral edge of a front end surface 10 of the valve body 5. Each of a plurality of rotation prevention grooves 13 is formed as a partial cut or notch in the nozzle plate accommodation part 8 between the arc-shaped walls 12 and 12 adjacent to each other.

As illustrated in FIGS. 3A to 4C, the arc-shaped walls 12 accommodate arm parts 14 of the nozzle plate 3 radially inward. The arc-shaped walls 12 have a projection height from the front end surface 10 (nozzle plate supporting part) of the valve body 5 less than the thickness of the nozzle plate 3. In addition, each of the arc-shaped walls 12 has swage projections (swage parts as nozzle plate fixation parts) 15 formed integrally with the end part close to the rotation prevention groove 13.

Figure 2D:
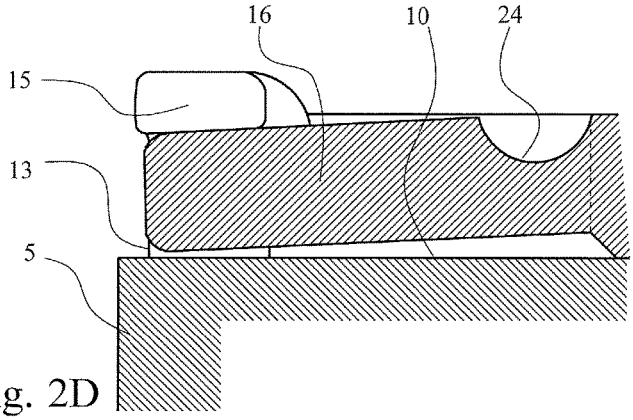

As illustrated in FIGS. 3A to 4C, the projection height of the swage projection 15 from the front end surface 10 of the valve body 5 is larger than the thickness of the nozzle plate 3, and the swage projection 15 is formed integrally with the arc-shaped wall 12 to obtain a sufficient swage margin. In addition, as illustrated in FIGS. 2A-2D, the swage projection 15 is bent (plastically deformed) toward the rotation prevention groove 13 to push the front end side of a spring action part 16 of the nozzle plate 3 engaging with the rotation prevention groove 13 against the front end surface 10 of the valve body 5 and swage-fix the spring action part 16 of the nozzle plate 3 to the front end surface 10 of the valve body 5 while being elastically deformed (bent). At this time, as illustrated in FIG. 2D, a space is generated between the spring action part 16 swage-fixed by the swage projection 15 and the front end surface 10 of the valve body 5. The pushing force generated by the elastic deformation of the spring action part 16 of the nozzle plate 3 is sufficient to obtain the seal performance (performance for preventing the leakage of fuel from between a back surface 17 of a nozzle hole formation part 18 and the front end surface 10 of the valve body 5) between the nozzle plate 3 and the valve body 5 even in consideration of the accuracy of assembling the nozzle plate 3 to the valve body 5, changes in temperature depending on the use environment, and the like.

Figure 3A:
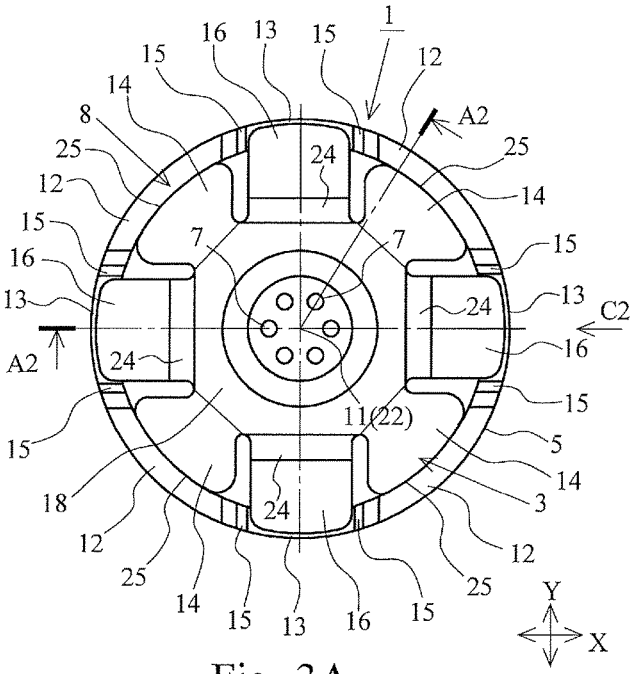
FIGS. 3A-3C illustrate the relationship between the nozzle plate and a valve body according to the first embodiment of the invention and the state in which the nozzle plate is not yet swage-fixed to the valve body. In particular.
Figure 3B:
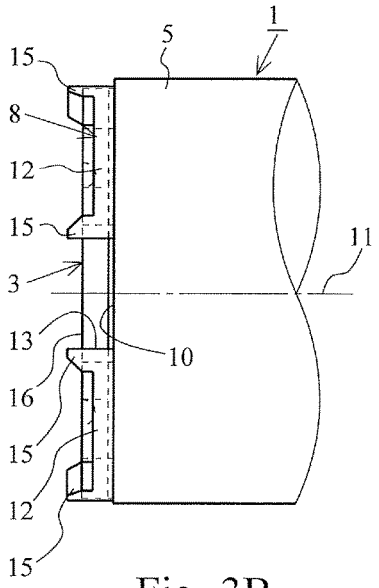
Figure 3C:
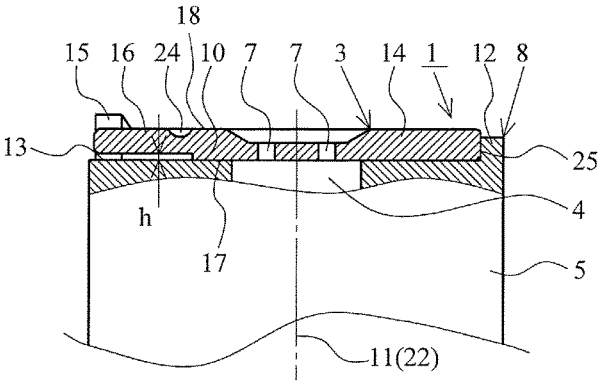
Figure 4A:
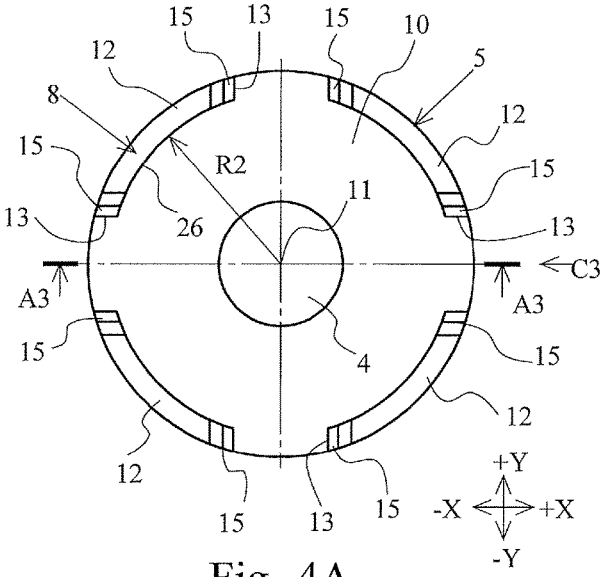
FIGS. 4A-4C illustrate the valve body according to the first embodiment of the invention. In particular.
Figure 4B:
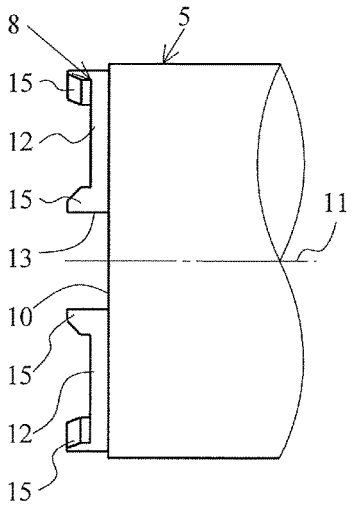
Figure 4C:
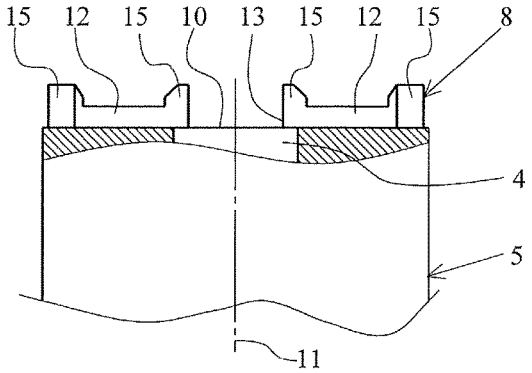

As illustrated in FIG. 4A, when the virtual plane orthogonal to the central axis 11 of the valve body 5 is assumed to be the X-Y plane, the pair of rotation prevention grooves 13 is formed along the X-axis direction and the pair of rotation prevention grooves 13 is formed along the Y-axis direction so as to engage with the cantilever-shaped spring action part 16 of the nozzle plate 3. The pair of rotation prevention grooves 13 formed along the X-axis direction is disposed symmetrically with respect to the central axis 11 of the valve body 5. The pair of rotation prevention grooves 13 formed along the Y-axis direction is disposed symmetrically with respect to the central axis 11 of the valve body 5. In addition, as illustrated in FIG. 3, when engaging with the spring action part 16 of the nozzle plate 3, the rotation prevention groove 13 prevents the nozzle plate 3 from deviating rotatably (rotating) about the central axis 11 of the valve body 5.

As illustrated in FIGS. 2A to 5C, the nozzle plate 3 is a plate to be accommodated in the nozzle plate accommodation part 8 formed on the front end side of the valve body 5 so that the back surface 17 of the arm part 14 and the nozzle hole formation part 18 makes contact with the front end surface 10 (nozzle plate supporting part) of the valve body 5. The nozzle plate 3 includes the nozzle hole formation part 18 in which the plurality of nozzle holes 7 are formed, the spring action parts 16 formed like cantilevers in four positions at regular intervals around the nozzle hole formation part 18, and the arm parts 14 formed in four positions at regular intervals around the nozzle hole formation part 18 between the spring action parts 16 and 16 adjacent to each other.

Figure 5A:
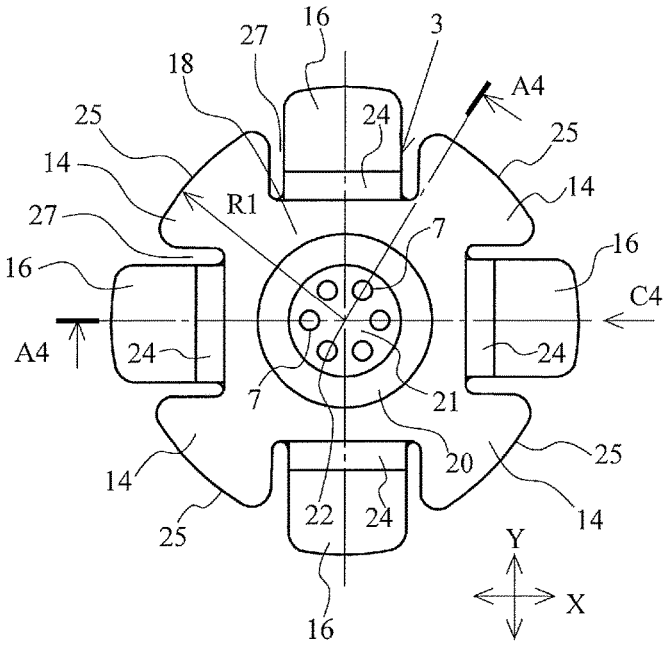
FIGS. 5A-5C illustrate the nozzle plate according to the first embodiment of the invention. In particular.
Figure 5B:
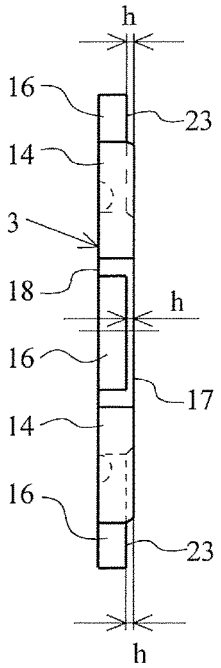
Figure 5C:
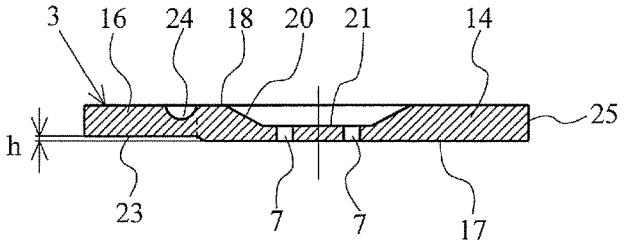
Figure 6A:
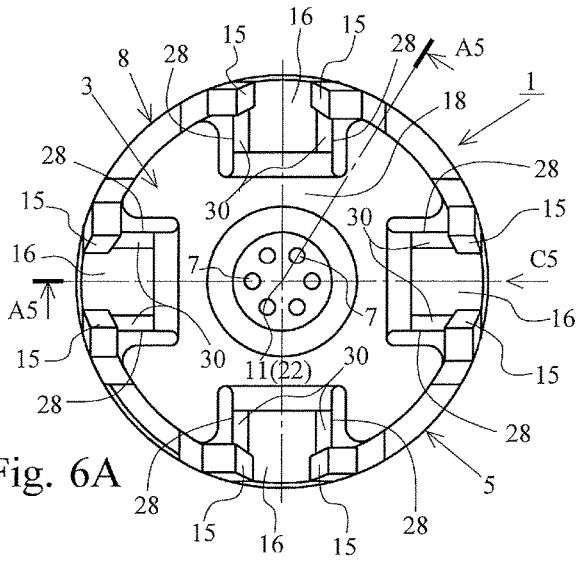
FIGS. 6A-6D illustrate an attachment structure of a nozzle plate according to a second embodiment of the invention. In particular.
Figure 6B:
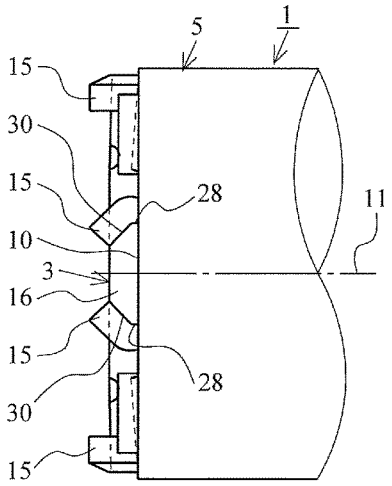
Figure 6C:
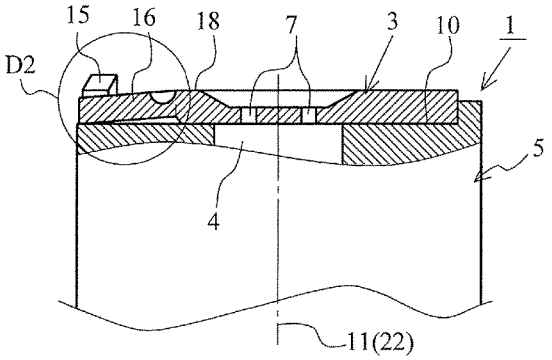
Figure 6D:
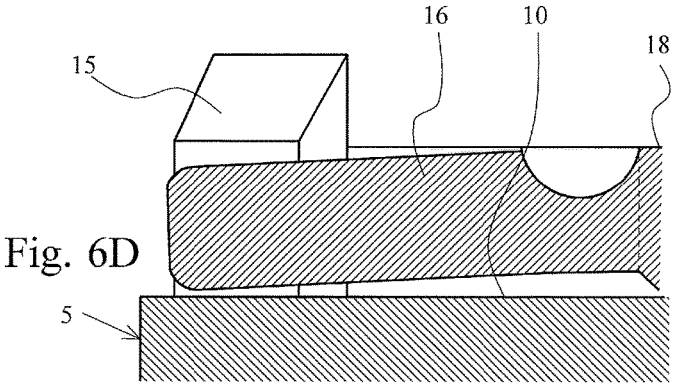
Figure 7A:
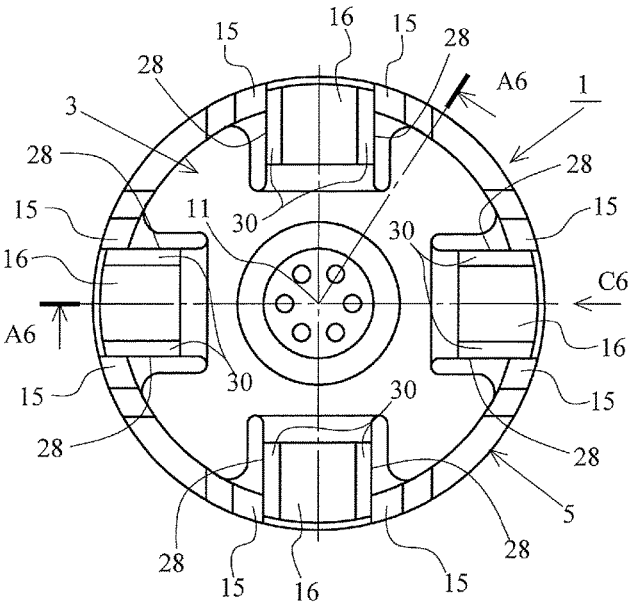
FIGS. 7A-7C illustrate the relationship between the nozzle plate and the valve body according to the second embodiment of the invention and the state in which the nozzle plate is not yet swage-fixed to the valve body. In particular.
Figure 7B:
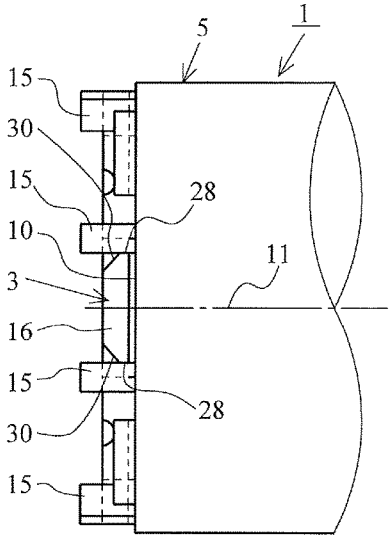
Figure 7C:
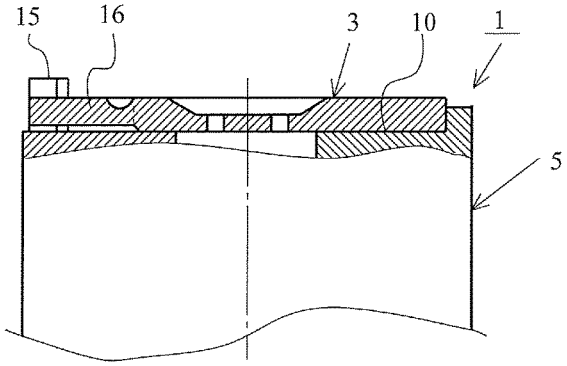
Figure 8A:
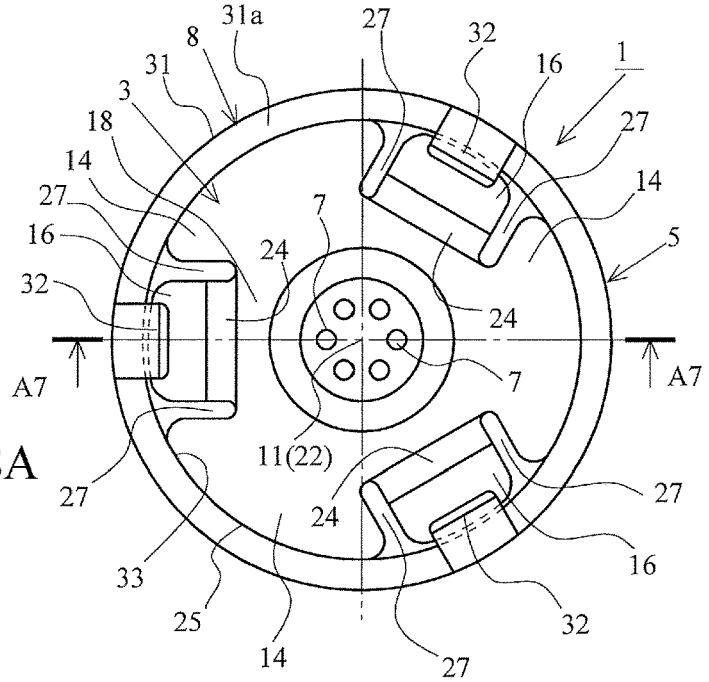
FIGS. 8A-8C illustrate an attachment structure of a nozzle plate according to a third embodiment of the invention. In particular.
Figure 8B:
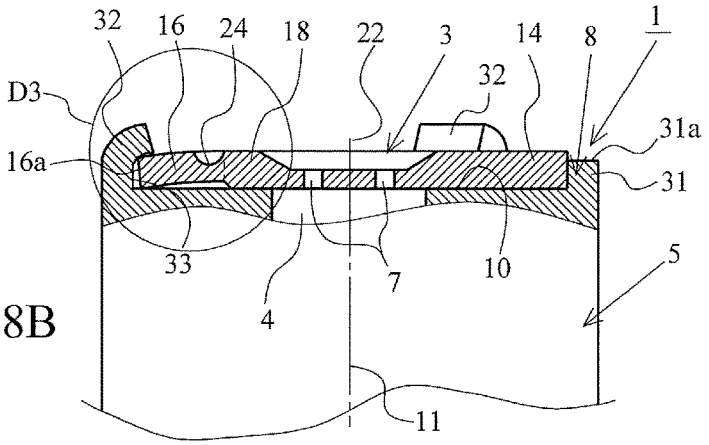
Figure 8C:
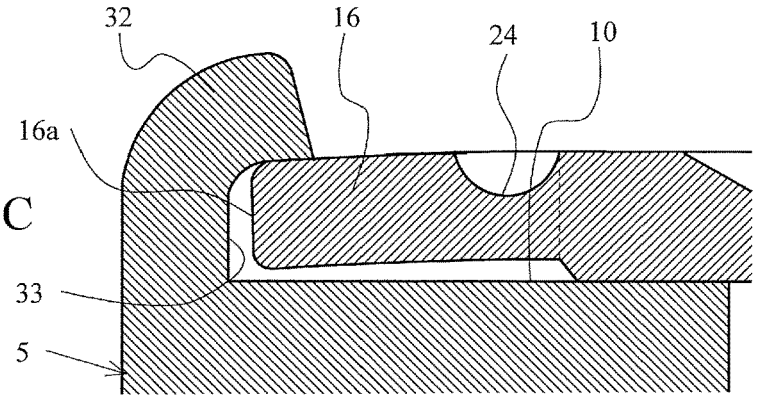
Figure 9A:
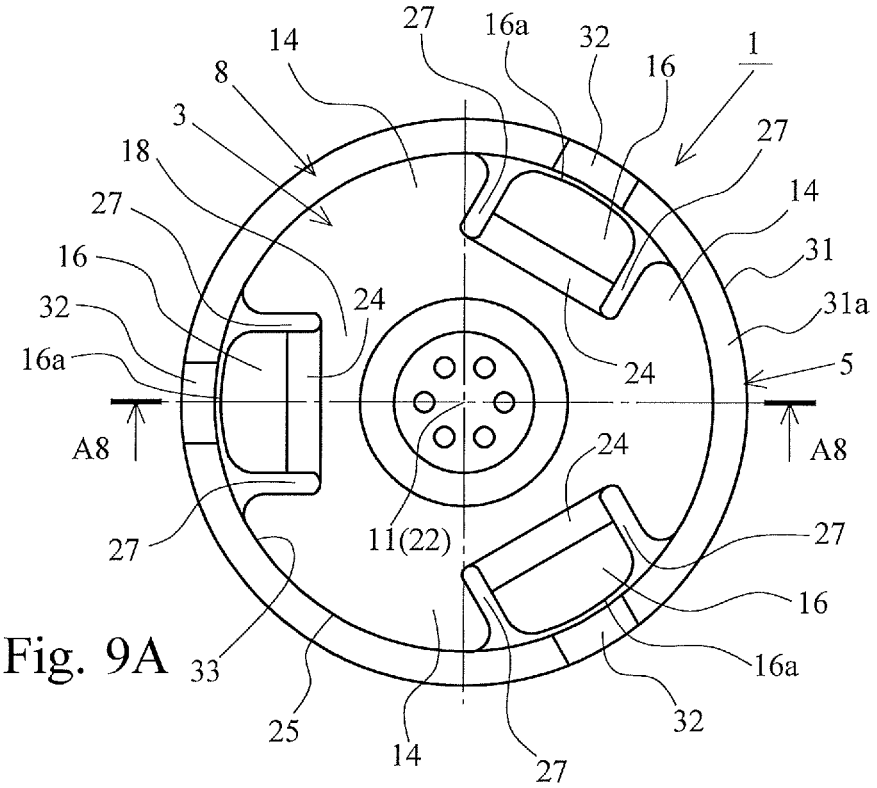
FIGS. 9A-9B illustrate the relationship between the nozzle plate and the valve body according to the third embodiment of the invention, and the state in which the nozzle plate is not yet swage-fixed to the valve body. In particular.
Figure 9B:
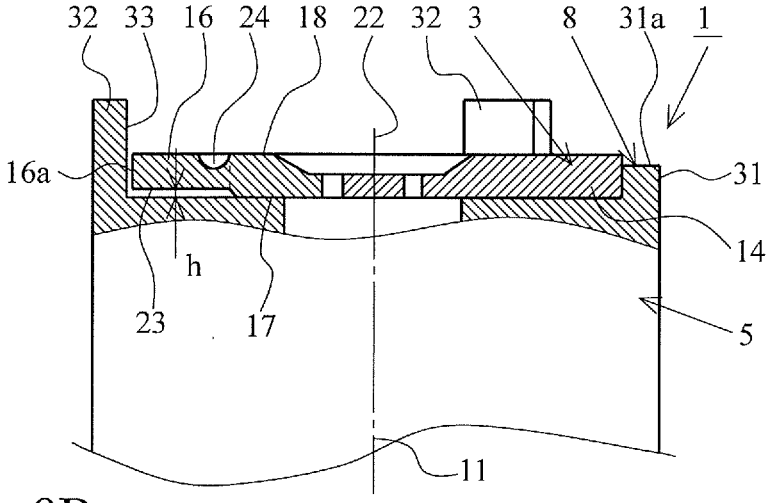
Figure 10A:
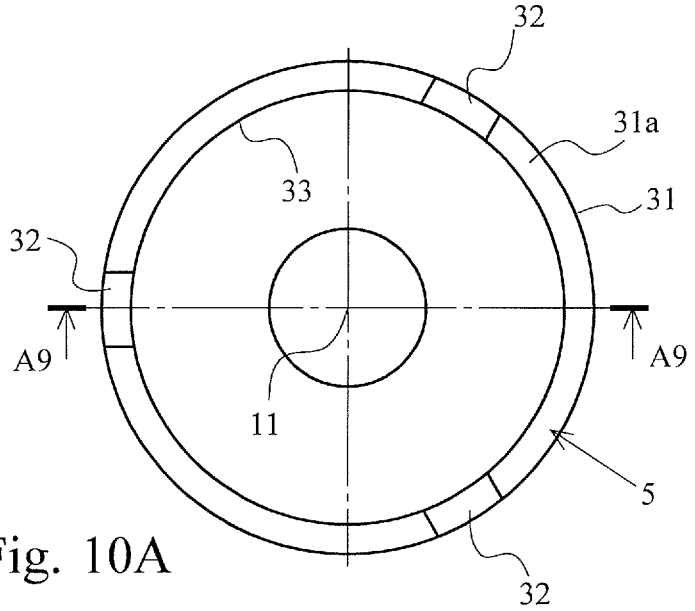
FIGS. 10A-10B illustrate the valve body according to the third embodiment of the invention. In particular.
Figure 10B:
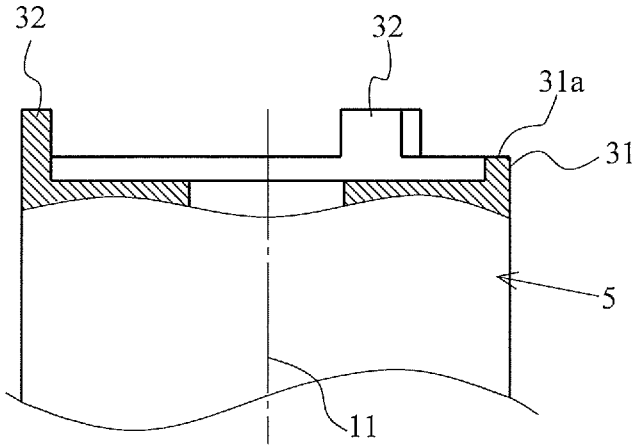
Figure 11B:
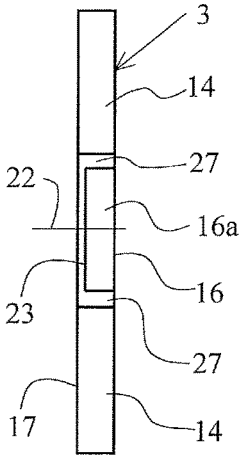
FIGS. 11A-11C illustrate the nozzle plate according to the third embodiment of the invention. In particular.
Figure 11A:
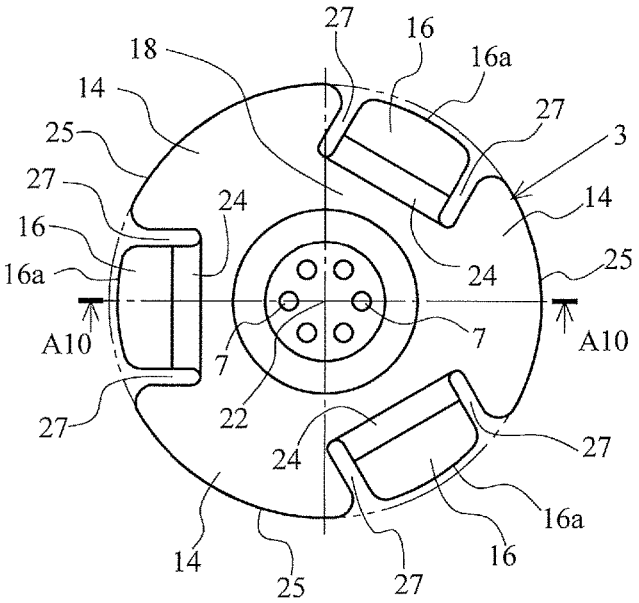
Figure 11C:
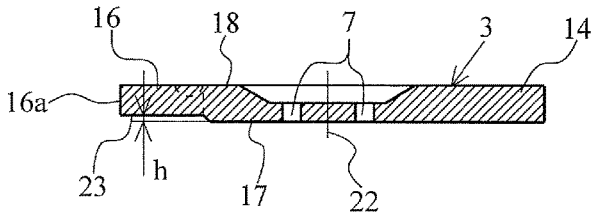

As illustrated in FIGS. 5A-5C, the nozzle hole formation part 18 faces the fuel injection port 4 when the nozzle plate 3 is accommodated in the nozzle plate accommodation part 8 of the valve body 5 and has a mortar-shaped (inverted-cone-shaped) recessed portion 20 at the center (see FIGS. 2C and 3C). The plurality of nozzle holes 7 are formed in a bottom wall 21 of the recessed portion 20 of the nozzle hole formation part 18. The plurality of nozzle holes 7 are formed at regular intervals about a center 22 (the center 22 of the nozzle plate 3) of the recessed portion 20 and atomize the fuel injected from the fuel injection port 4 of the valve body 5. Although the nozzle holes 7 are formed in six positions at regular intervals in the nozzle hole formation part 18 in the embodiment, the invention is not limited to the embodiment, and a required number of nozzle holes 7 are formed depending on the use condition or the like. In addition, although the plurality of nozzle holes 7 are formed at regular intervals in the nozzle hole formation part 18 in the aspect, the invention is not limited to the aspect and the plurality of nozzle holes 7 may be formed at irregular intervals in the nozzle hole formation part 18.

As illustrated in FIGS. 5A-5C, the spring action part 16 is substantially rectangular in plan view and engages with the rotation prevention groove 13 of the valve body 5. The entire spring action part 16 is thinner than the nozzle hole formation part 18 so that a back surface 23 is recessed by a predetermined dimension (step dimension) h from the back surface 17 of the nozzle hole formation part 18 and the arm part 14. In addition, the spring action part 16 has a groove 24 in the connection portion connecting to the nozzle hole formation part 18, and the connection portion connecting to the nozzle hole formation part 18 is thinner than the other part. The groove 24 of the spring action part 16 is arc-shaped in a cross section (cross section taken along line A4-A4 in FIG. 5A) orthogonal to the groove and extends across the entire length in the width direction of the spring action part 16. The spring action part 16 is easily bent in the thin connection portion (in which the groove 24 is formed) connecting to the nozzle hole formation part 18 and the entire body is elastically deformed. Note that the radially outward end of the spring action part 16 does not project radially outward of the valve body 5 in the state in which the nozzle plate 3 is accommodated in the nozzle plate accommodation part 8 of the valve body 5 (see, e.g., FIG. 3C).

As illustrated in FIG. 5A, a radially outward end 25 of the arm part 14 is shaped like an arc following a radially inner surface 26 of the arc-shaped wall 12 of the valve body 5, and a radius R1 of the radially outward end 25 is slightly smaller than a radius R2 of the radially inner surface 26 of the arc-shaped wall 12. Since the arm parts 14 are formed in four positions at regular intervals around the center 22 of the nozzle plate 3, deviation in the radial direction is prevented by the arc-shaped wall 12 of the valve body 5 when the nozzle plate 3 is accommodated in the nozzle plate accommodation part 8 of the valve body 5 and the center 22 of the nozzle plate 3 is aligned with the central axis 11 of the valve body 5. Both sides of the arm part 14 are separated from the side surfaces of the adjacent spring action parts 16 by cut grooves 27. Accordingly, the spring action part 16 is bent (elastically deformed) independently so as to be supported by the nozzle hole formation part 18 like a cantilever.

The nozzle plate 3 formed as described above is positioned (prevented from rotating with respect to the valve body 5 and the center 22 is aligned with the central axis 11 of the valve body 5) and accommodated in the nozzle plate accommodation part 8 of the valve body 5 when the spring action part 16 engages with the rotation prevention groove 13 and the arm part 14 engages with the radially inner surface 12 of the arc-shaped wall 12 of the valve body 5 (see FIGS. 3A to 3C). Next, the swage projection 15 of the valve body 5 is bent (plastically deformed) toward the rotation prevention groove 13 by a swage tool (not illustrated), the spring action part 16 of the nozzle plate 3 is bent (elastically deformed) like a cantilever from the connection portion connecting to the nozzle hole formation part 18, and the front end side of the spring action part 16 is pushed against and fixed to the front end surface 10 (nozzle plate supporting part) of the valve body 5 (see FIG. 2). At this time, the elastic deformation of the spring action part 16 is smaller than the step dimension h between the back surface 17 of the arm part 14 and the nozzle hole formation part 18 and the back surface 23 of the spring action part 16, and the spring action part 16 is swage-fixed so that a space is created with respect to the front end surface 10 of the valve body 5. As a result, the back surface 17 of the arm part 14 and the nozzle hole formation part 18 is pushed against the front end surface 10 of the valve body 5 by the elastic force of the spring action part 16. Although the spring action parts 16 and the arm parts 14 are formed in four positions around the nozzle hole formation part 18 in the embodiment, the invention is not limited to the embodiment and the spring action parts 16 and the arm parts 14 may be formed in two or more positions. In addition, by making the width dimension of one of the plurality of spring action parts 16 different from that of the others and forming the rotation prevention groove 13 engaging with the one spring action part 16 with a slight clearance left in the valve body 5, it is possible to prevent assembly error in the rotational direction from occurring during assembling of the nozzle plate 3 and the valve body 5. In addition, although the attachment structure of the nozzle plate 3 according to the embodiment adopts an aspect in which a space is generated between the spring action part 16 fixed by the swage projection 15 and the front end surface 10 of the valve body 5 (see FIG. 2D), the invention is not limited to the aspect and the front end side of the spring action part 16 may be brought into contact with the swage projection 15 and the front end surface 10 of the valve body 5 as long as the elastic deformation of the spring action part 16 can absorb effects of the accuracy of assembling the nozzle plate 3 and the valve body 5, effects (effects caused by the difference in thermal expansion between the nozzle plate 3 and the valve body 5) of changes in the temperature in the use environment and the like, the elastic force of the spring action part 16 can push the back surface 17 of the nozzle hole formation part 18 against the front end surface 10 of the valve body 5, and it is possible to prevent the leakage of fuel from between the back surface 17 of the nozzle hole formation part 18 and the front end surface 10 of the valve body 5.

Effect of First Embodiment

In the attachment structure of the nozzle plate 3 according to the embodiment, the nozzle plate 3 is fixed to the front end side of the valve body 5 by plastically deforming the swage projection 15 of the valve body 5. Accordingly, in the attachment structure of the nozzle plate 3 according to the embodiment, the manufacturing man-hours and manufacturing cost of the fuel injection device 1 can be reduced as compared with the conventional example in which the nozzle plate of metal is fixed to the front end of the valve body of metal by welding.

In addition, in the attachment structure of the nozzle plate 3 according to the embodiment, since the nozzle plate 3 is swage-fixed to the front end side of the valve body 5 while the spring action part 16 is elastically deformed, the back surface 17 of the arm part 14 and the nozzle hole formation part 18 is constantly pushed against the front end surface 10 (nozzle plate supporting part) of the valve body 5 by the elastic force of the spring action part 16. Accordingly, in the attachment structure of the nozzle plate 3 according to the embodiment, the manufacturing error of the nozzle plate 3 and the valve body 5 can be absorbed by the elastic deformation of the spring action part 16, the difference in thermal expansion between the nozzle plate 3 and the valve body 5 can be absorbed by the elastic deformation of the spring action part 16, and the nozzle plate 3 can be surely fixed to the front end side of the valve body 5.

Second Embodiment

FIGS. 6A to 7C are diagrams of attachment structures of the nozzle plate 3 according to a second embodiment of the invention and illustrate a modification of the first embodiment.

In the attachment structures of the nozzle plate 3 illustrated in FIGS. 6A to 7C, the shape of the spring action part 16 of the nozzle plate 3 is different from that of the spring action part 16 according to the first embodiment, but the other of the structure is the same as in the attachment structure of the nozzle plate 3 according to the first embodiment.

That is, in the embodiment, the spring action part 16 of the nozzle plate 3 has swage inclined planes 30 so as to chamfer the upper parts of both side surfaces 28 and 28 and the swage projection 15 plastically deformed by a swage tool (not illustrated) presses the swage inclined plane 30.

In the attachment structure of the nozzle plate 3 according to the embodiment, effects similar to those in the attachment structure of the nozzle plate 3 according to the first embodiment can be obtained.

Third Embodiment

FIGS. 8A to 11C illustrate an attachment structure of the nozzle plate 3 according to a third embodiment of the invention.

As illustrated in FIGS. 8A to 10B in the embodiment, the valve body 5 has an annular projection 31 as the nozzle plate accommodation part 8 along the radially outward edge of the front end surface 10, and swage projections 32 (swage parts as nozzle plate fixation parts) are formed integrally in three positions in the circumferential direction of a front end surface 31*a* of the annular projection 31. The three swage projections 32 are formed in the three positions at regular intervals on the front end surface 31*a* of the annular projection 31.

As illustrated in FIGS. 8A to 11C, the spring action parts 16 of the nozzle plate 3 are formed in three positions at regular intervals on the outer peripheral side of the nozzle hole formation part 18, and the spring action parts 16 are disposed so as to correspond one-to-one to the swage projections 32. In addition, in the nozzle plate 3, the arm parts 14 are formed in three positions at regular intervals on the outer peripheral side of the nozzle hole formation part 18, and each arm part 14 is disposed between adjacent spring action parts 16. The arm part 14 is arc-shaped so that a radially outward end 25 engages with an inner peripheral surface 33 of the annular projection 31 of the valve body 5 with a slight clearance left, and the center 22 of the nozzle plate 3 is aligned with the central axis 11 of the valve body 5. In addition, a radially outward end 16*a* (front end) of the spring action part 16 is shaped like an arc following the inner peripheral surface 33 of the annular projection 31 and the radially outward end 16*a* is formed so as to create a sufficient space (large enough to absorb the elastic deformation of the spring action part 16 and the deformation caused by thermal expansion and the like) with respect to the inner peripheral surface 33 of the annular projection 31. As in the spring action part 16 according to the first embodiment, this spring action part 16 has the groove 24 in the connection portion connecting to the nozzle hole formation part 18 and the connection portion connecting to the nozzle hole formation part 18 is thin so that the connection portion is easily deformed. In addition, the spring action part 16 is separated from the adjacent arm parts 14 by the cut grooves 27 on both sides so that the spring action part 16 can be bent (elastically deformed) independently.

When the nozzle plate 3 configured as described above is accommodated in the nozzle plate accommodation part 8 on the front end side of the valve body 5 and positioned so that the spring action part 16 corresponds one-to-one to the swage projection 32 (see FIG. 9), the swage projection 32 of the valve body 5 is bent (plastically deformed) by a swage tool (not illustrated) radially inward of the valve body 5. Therefore, the spring action part 16 is bent (elastically deformed) by the swage projection 32 having been plastically deformed, and the front end side of the spring action part 16 is fixed to the front end surface 10 (nozzle plate supporting part) of the valve body 5 while being pushed against the front end surface 10 of the valve body 5 (see FIG. 8). At this time, the elastic deformation of the spring action part 16 is less than the step dimension h between the back surface 23 and the back surface 17 of the nozzle hole formation part 18 and the spring action part 16 is fixed so that a space is created with respect to the front end surface 10 of the valve body 5 (see FIGS. 8C and 9B). The nozzle plate 3 is constantly pushed against the front end surface 10 of the valve body 5 by the elastic force of the spring action part 16 and surely fixed to the front end side of the valve body 5.

In the attachment structure of the nozzle plate 3 according to the embodiment, effects similar to those in the attachment structure of the nozzle plate 3 according to the first embodiment can be obtained.

Fourth Embodiment

Figure 12A:
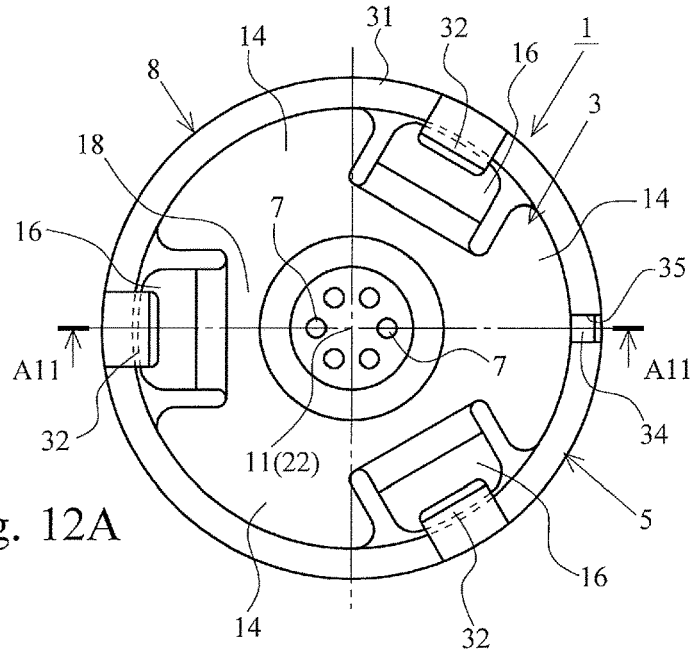
FIGS. 12A-12C illustrate an attachment structure of a nozzle plate according to a fourth embodiment of the invention and a modification of the third embodiment. In particular.
Figure 12B:
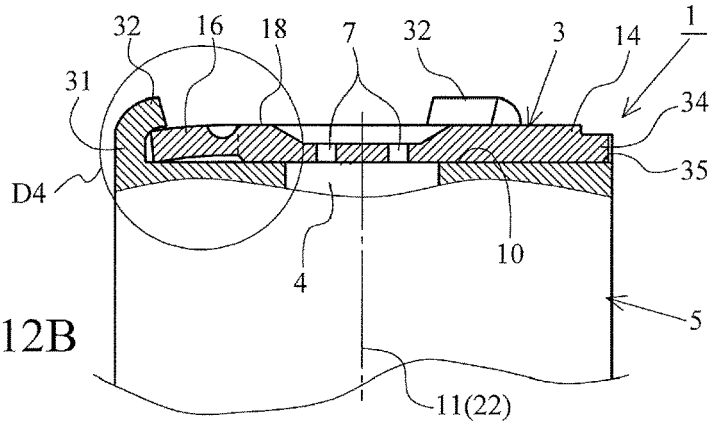
Figure 12C:
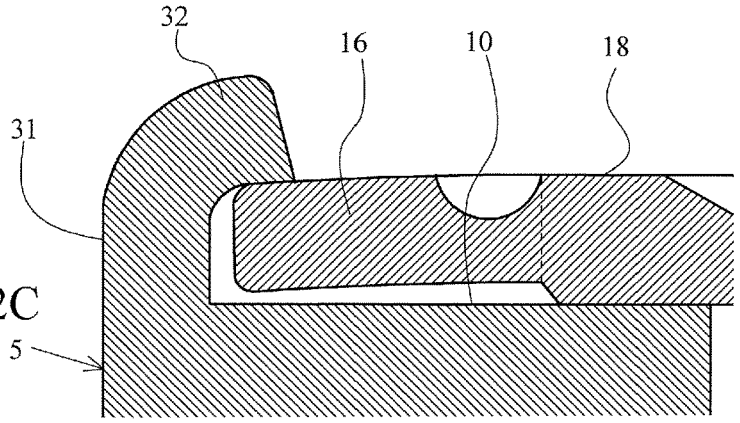
Figure 13A:
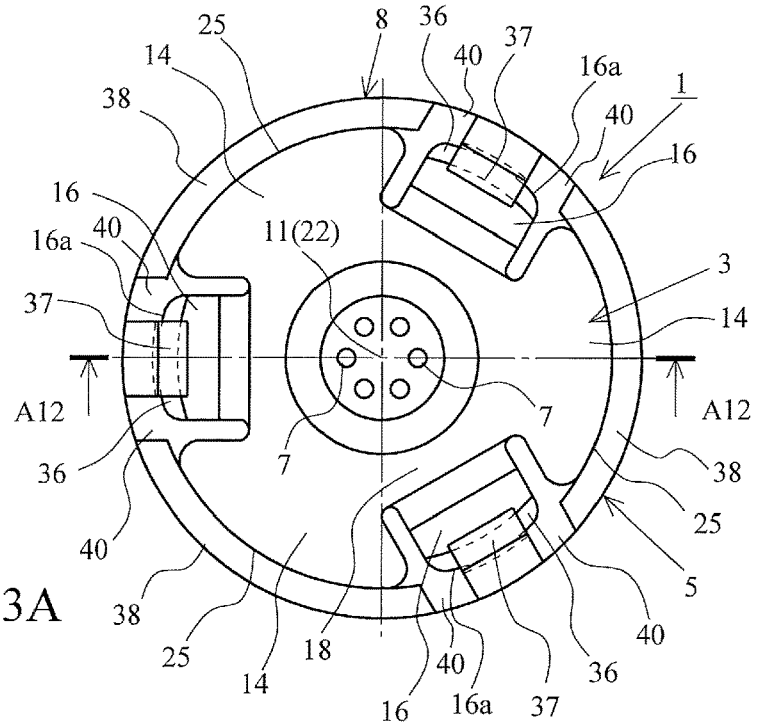
FIGS. 13A-13C illustrate an attachment structure of the nozzle plate 3 according to a fifth embodiment of the invention and a modification of the third embodiment. In particular.
Figure 13B:
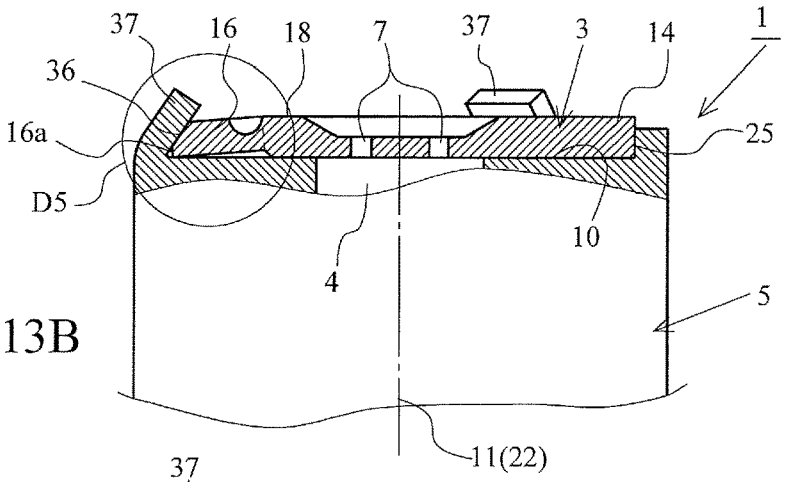
Figure 13C:
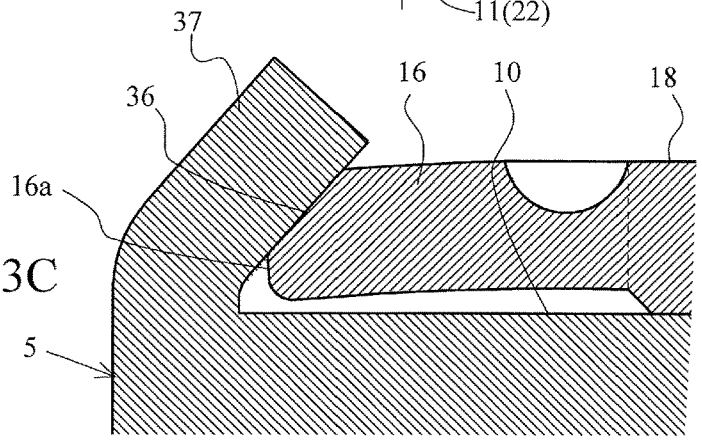
Figure 14A:
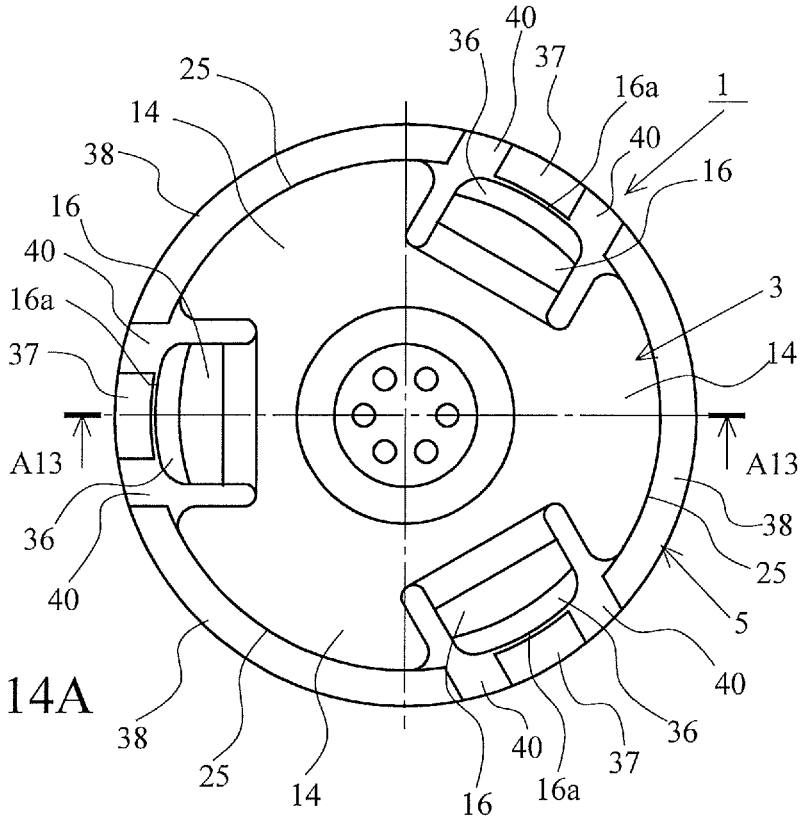
FIGS. 14A-14B illustrate the relationship between the nozzle plate and a valve body according to the fifth embodiment of the invention and the state in which the nozzle plate is not yet swage-fixed to the valve body. In particular.
Figure 14B:
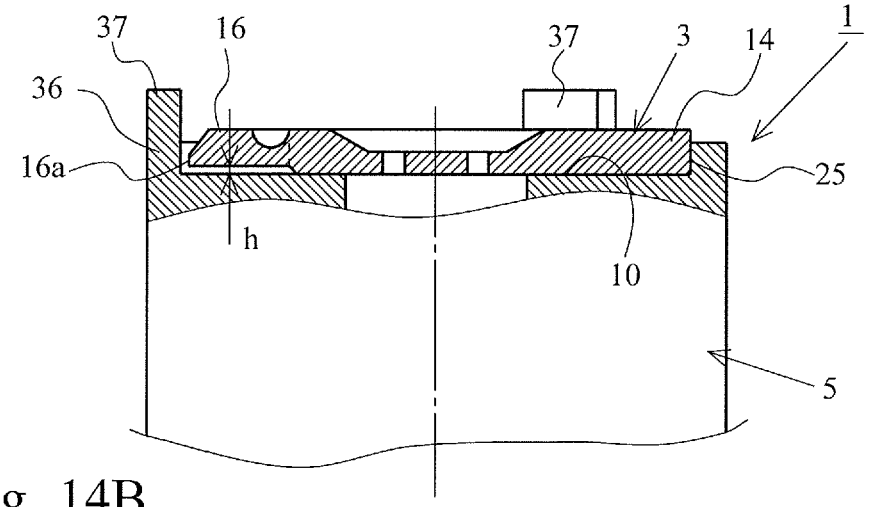
Figure 15A:
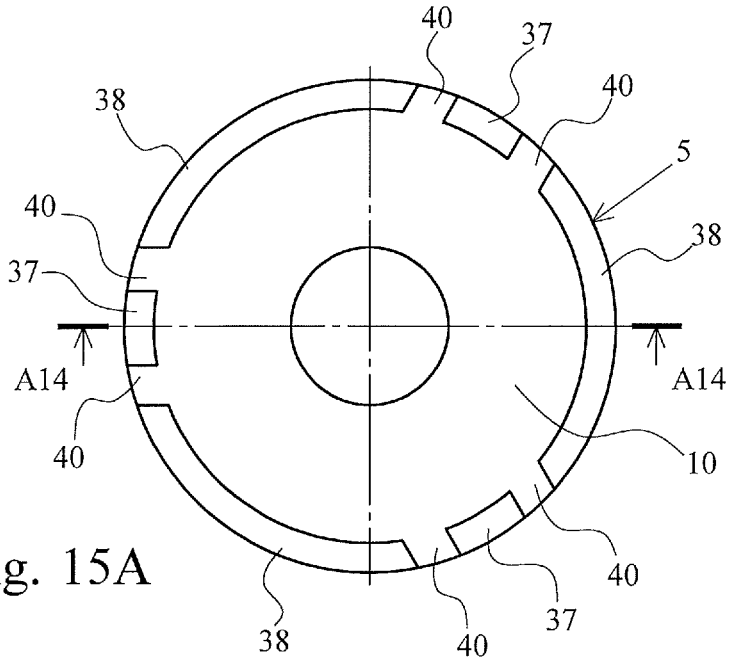
FIGS. 15A-15B illustrate the valve body according to the fifth embodiment of the invention. In particular.
Figure 15B:
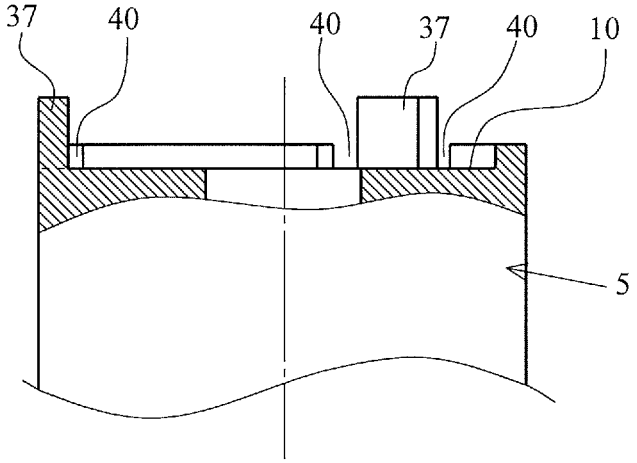
Figure 16B:
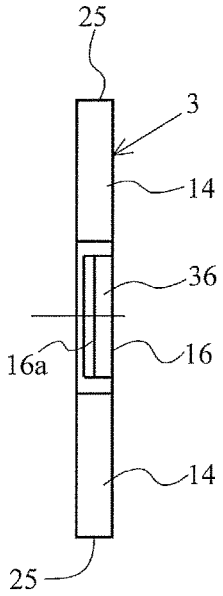
FIGS. 16A-16C illustrate the nozzle plate according to the fifth embodiment of the invention. In particular.
Figure 16A:
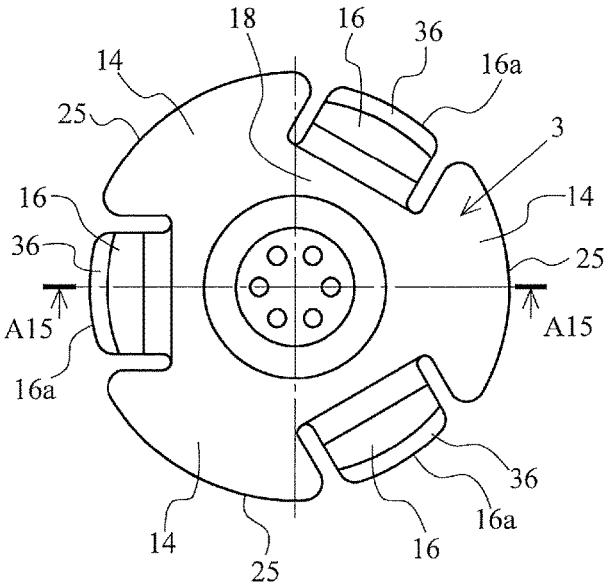
Figure 16C:
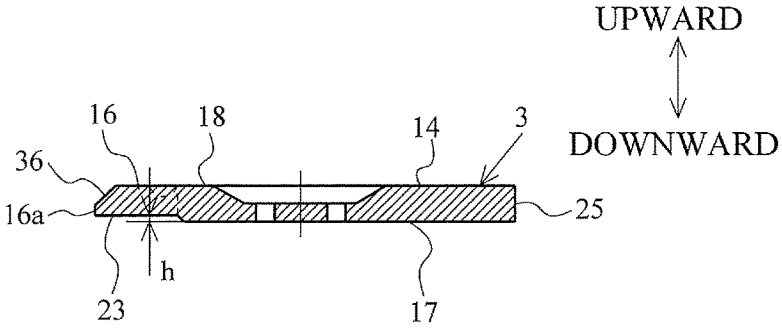

FIGS. 12A-12C are diagrams of an attachment structure of the nozzle plate 3 according to a fourth embodiment of the invention, and illustrates a modification of the third embodiment.

As illustrated in FIGS. 12A-12C, the attachment structure of the nozzle plate 3 according to the embodiment is the same as that of the nozzle plate 3 according to the third embodiment, except that a rotation prevention projection 34 is formed so as to project from the radially outward end (front end) 25 of one of the three arm parts 14, and a rotation prevention groove 35 engaging with the rotation prevention projection 34 is formed in the annular projection 31 of the valve body 5.

In addition, in the attachment structure of the nozzle plate 3 according to the embodiment having such a structure, the nozzle plate 3 can be swage-fixed to the front end side of the valve body 5 in the state in which the nozzle plate 3 is accurately and simply positioned with respect to the valve body 5.

In the attachment structure of the nozzle plate 3 according to the embodiment, effects similar to those in the attachment structure of the nozzle plate 3 according to the first embodiment can be obtained.

Fifth Embodiment

FIGS. 13 to 16 are diagrams of an attachment structure of the nozzle plate 3 according to a fifth embodiment of the invention and illustrate a modification of the third embodiment.

In the attachment structure of the nozzle plate 3 according to the embodiment illustrated in FIGS. 13A to 16C, the shape of the spring action part 16 of the nozzle plate 3 is different from that of the spring action part 16 according to the third embodiment, and the shape of the nozzle plate accommodation part 8 of the valve body 5 is different from that of the nozzle plate accommodation part 8 according to the third embodiment. The remaining structure is the same as in the attachment structure of the nozzle plate 3 according to the third embodiment.

In the fifth embodiment, the spring action part 16 of the nozzle plate 3 has a swage inclined plane 36 so as to chamfer the upper part of the radially outward end (front end) 16*a*. The swage inclined plane 36 is pushed toward the front end surface 10 (nozzle plate supporting part) of the valve body 5 by a swage projection 37 having been plastically deformed when the swage projection (swage part as a nozzle plate fixation part) 37 of the valve body 5 is plastically deformed by a swage tool (not illustrated), the entire body is bent (elastically deformed), and a space is generated with respect to the front end surface 10 of the valve body 5 (see FIG. 13C).

In addition, in the embodiment, the valve body 5 has arc-shaped walls 38 in three positions that engage with the radially outward ends 25 of the arm parts 14 of the nozzle plate 3 with a slight clearance left, so as to correspond to the arm parts 14 of the nozzle plate 3. The swage projection 37 is formed between the arc-shaped walls 38 and 38 adjacent to each other via a slit 40. Since the swage projections 37 are formed in three positions at regular intervals so as to correspond to the spring action parts 16 in three positions of the nozzle plate 3 and separated from the arc-shaped walls 38, the three swage projections 37 can be bent from the vicinity (the vicinity of the front end surface 10 of the valve body 5) of the root and the swage inclined plane 36 of the nozzle plate 3 can be surely pressed.

In the attachment structure of the nozzle plate 3 according to the embodiment, effects similar to those in the attachment structure of the nozzle plate 3 according to the third embodiment can be obtained.

In the attachment structure of the nozzle plate 3 according to the embodiment, as in the attachment structure of the nozzle plate 3 according to the fourth embodiment, the rotation prevention projection 34 may be formed at the radially outward end (front end) 25 of one of the arm parts 14 of the nozzle plate 3 and the rotation prevention groove 35 engaging with the rotation prevention projection 34 may be formed in the arc-shaped wall 38 of the valve body 5 (see FIGS. 12A-12C).

Sixth Embodiment

FIGS. 17A to 18C are diagrams of an attachment structure of the nozzle plate 3 according to a sixth embodiment of the invention and illustrate a modification of the attachment structure of the nozzle plate 3 according to the third embodiment of the invention. Duplicate descriptions as in the third embodiment are omitted.

Figure 17A:
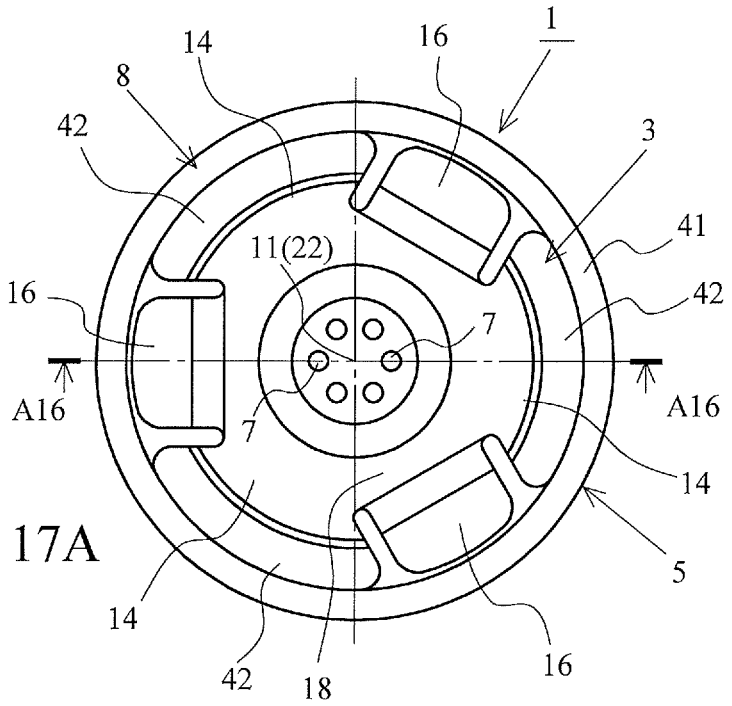
FIGS. 17A-17B illustrate the relationship between a nozzle plate and a valve body according to a sixth embodiment of the invention and the state in which the nozzle plate is not yet swage-fixed to the valve body. In particular.
Figure 17B:
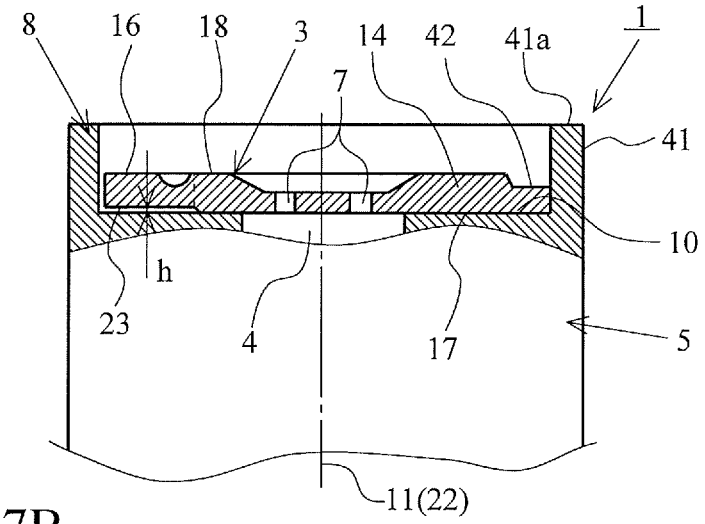

As illustrated in FIGS. 17A and 17B, in the state in which the nozzle plate 3 is not yet swage-fixed to the valve body 5, the projection height (the height from the front end surface 10 of the valve body 5 to a front end surface 41*a* of an annular projection 41) of the annular projection 41, which is the nozzle plate accommodation part 8, includes the swage margin and the projection height is sufficiently larger than the plate thickness of the nozzle plate 3.

Figure 18A:
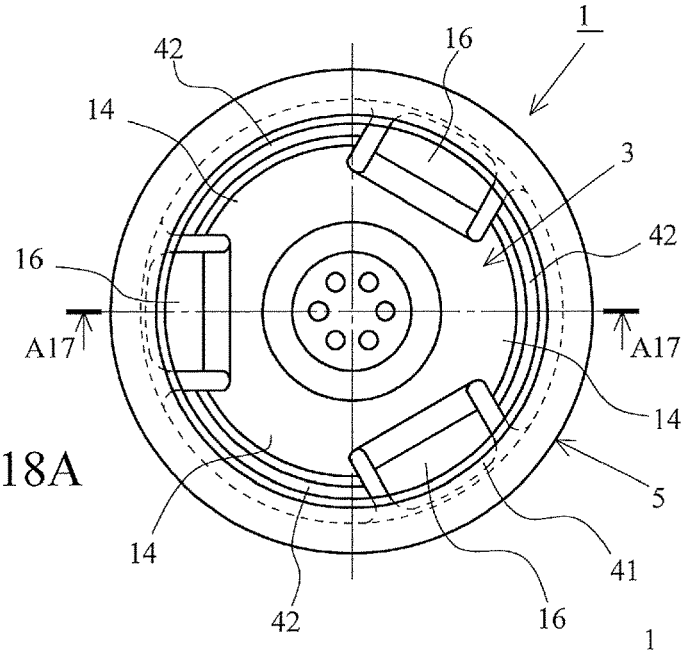
FIGS. 18A-18C illustrate an attachment structure of the nozzle plate according to the sixth embodiment of the invention and a modification of the third embodiment. In particular.
Figure 18B:
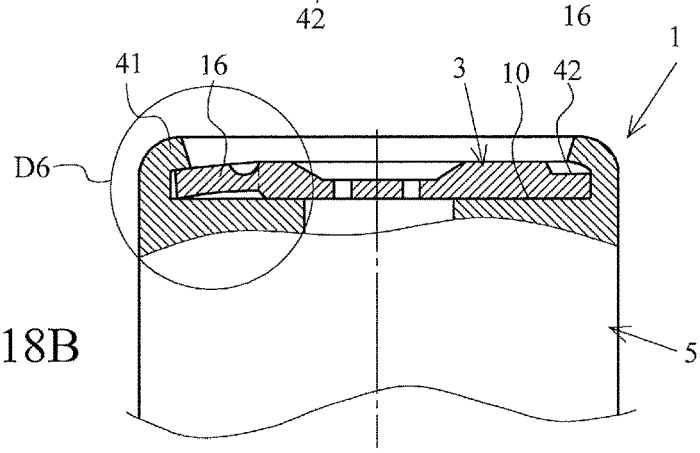
Figure 18C:
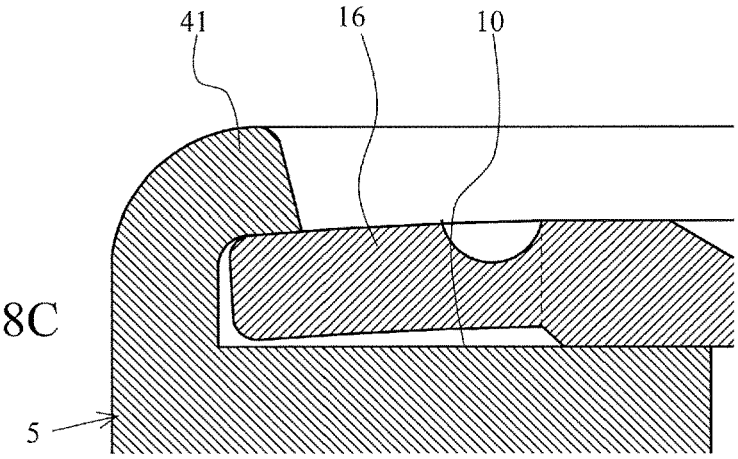

In addition, as illustrated in FIGS. 17A and 17B, when the nozzle plate 3 is accommodated in the nozzle plate accommodation part 8 and the entire periphery on the front end side of the annular projection 41 is swaged radially inward, the spring action part 16 of the nozzle plate 3 is fixed to the valve body 5 in the state in which the spring action part 16 of the nozzle plate 3 is bent (elastically deformed) by the amount less than the step dimension h between the front end surface 10 of the valve body 5 and the back surface 23 of the spring action part 16 (see FIGS. 17B and 18C). That is, in the embodiment, the part of the annular projection 41 that is disposed on the front end side and plastically deformed is used as the swage projection (swage part as a nozzle plate fixation part).

In addition, as illustrated in FIGS. 17 and 18, the nozzle plate 3 has a swage relief groove 42 radially outward of the arm part 14. Accordingly, the nozzle plate 3 is swage-fixed to the valve body 5 while mainly the spring action part 16 is elastically deformed by the annular projection (swage projection) 41. That is, in the sixth embodiment, the spring action part 16 of the nozzle plate 3 is surely fixed to the valve body 5 by the annular projection (swage projection) 41.

In the attachment structure of the nozzle plate 3 according to the embodiment, effects similar to those in the attachment structure of the nozzle plate 3 according to the third embodiment can be obtained.

Seventh Embodiment

Figure 19A:
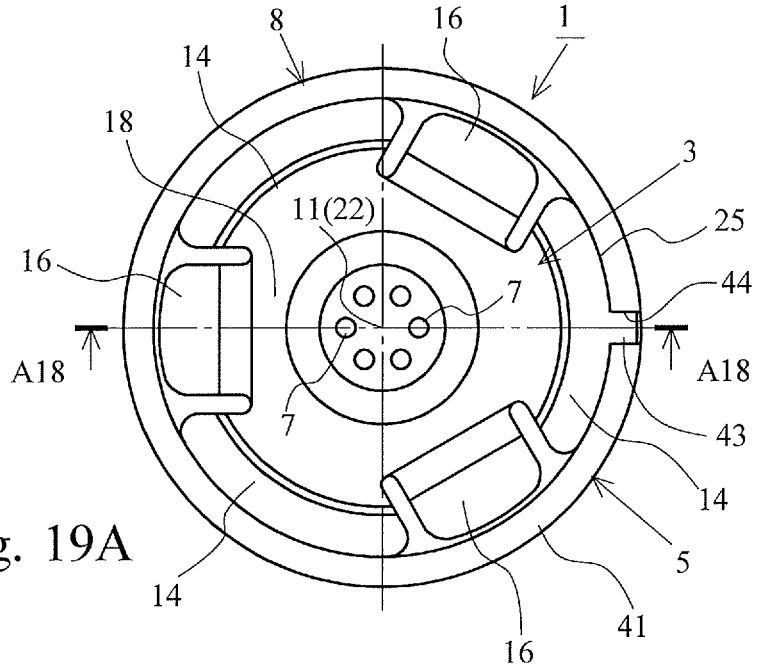
FIGS. 19A-19B illustrate an attachment structure of a nozzle plate according to a seventh embodiment of the invention and a modification of the sixth embodiment. In particular.
Figure 19B:
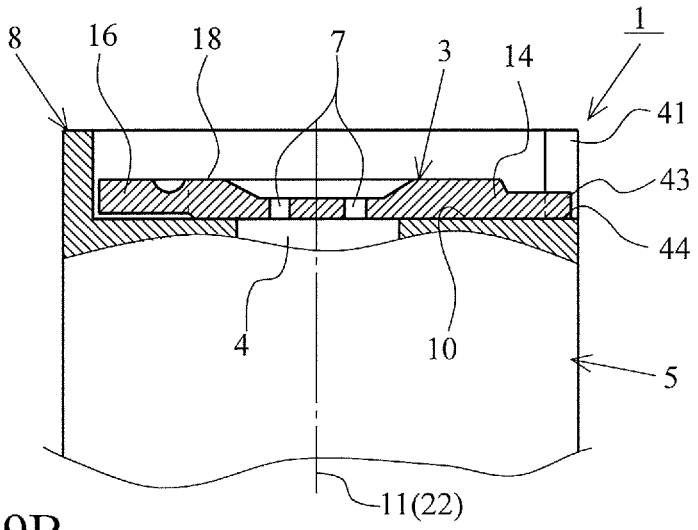
Figure 20A:
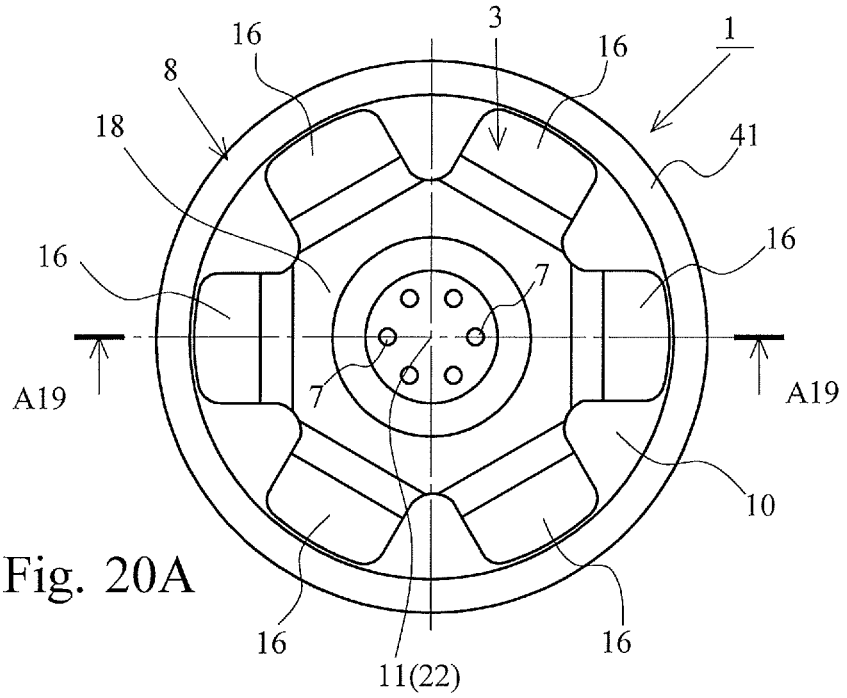
FIGS. 20A-20B illustrate the relationship between a nozzle plate and a valve body according to an eighth embodiment of the invention and the state in which the nozzle plate is not yet swage-fixed to the valve body. In particular.
Figure 20B:
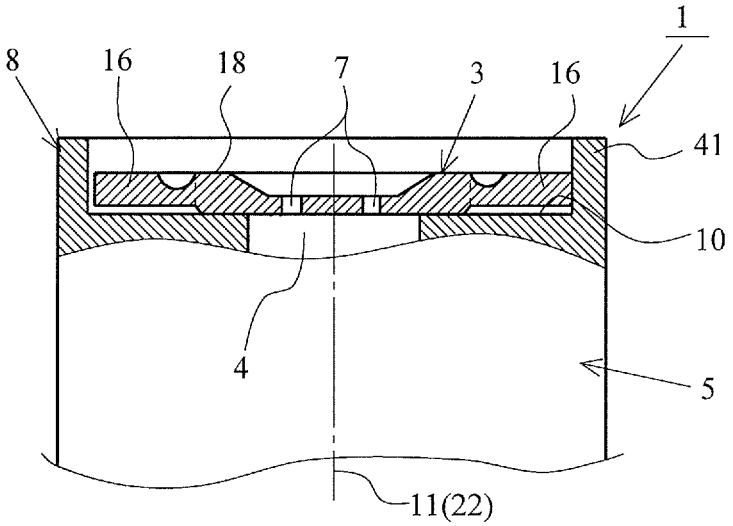
Figure 21A:
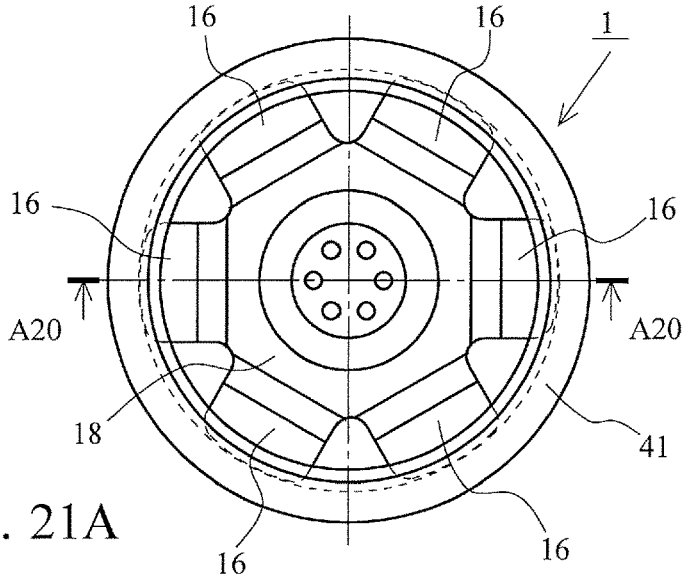
FIGS. 21A-21C illustrate an attachment structure of the nozzle plate according to the eighth embodiment of the invention and a modification of the sixth embodiment. In particular.
Figure 21B:
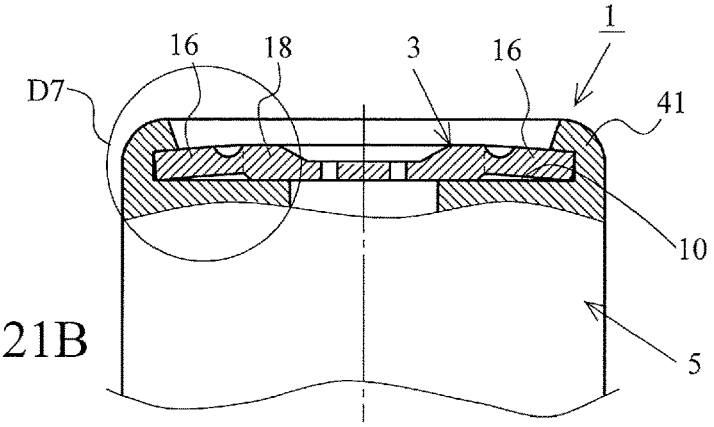
Figure 21C:
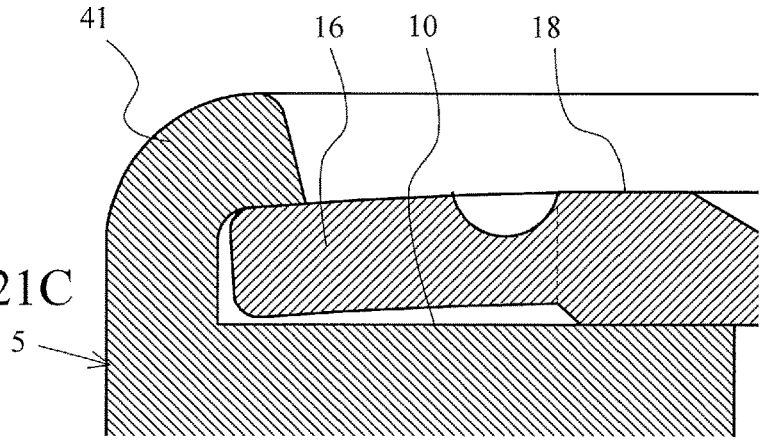

FIGS. 19A and 19B are diagrams of an attachment structure of the nozzle plate 3 according to a seventh embodiment of the invention, and illustrate a modification of the sixth embodiment.

As illustrated in FIGS. 19A and 19B, the attachment structure of the nozzle plate 3 according to the embodiment is the same as the attachment structure of the nozzle plate 3 according to the sixth embodiment, except that a rotation prevention projection 43 is formed so as to project from the radially outward end (front end) 25 of one of the three arm parts 14 and a rotation prevention groove 44 engaging with the rotation prevention projection 43 is formed in the annular projection 41.

In the attachment structure of the nozzle plate 3 according to the embodiment having such a structure, the nozzle plate 3 can be swage-fixed to the front end side of the valve body 5 in the state in which the nozzle plate 3 is accurately and simply positioned with respect to the valve body 5.

In the attachment structure of the nozzle plate 3 according to the seventh embodiment, effects similar to those in the attachment structure of the nozzle plate 3 according to the sixth embodiment can be obtained.

Eighth Embodiment

FIGS. 20A to 21C are diagrams of an attachment structure of the nozzle plate 3 according to an eighth embodiment of the invention and illustrate a modification of the sixth embodiment.

As illustrated in FIGS. 20A to 21C, in the attachment structure of the nozzle plate 3 according to the embodiment, the shape of the nozzle plate 3 is different from that of the nozzle plate 3 according to the sixth embodiment, but the remaining structure is the same as in the attachment structure of the nozzle plate 3 according to the six embodiment. That is, in the eighth embodiment, the nozzle plate 3 has the spring action parts 16 in six positions at regular intervals around the nozzle hole formation part 18 and does not have the arm part 14 (see FIGS. 17A to 18C).

In the attachment structure of the nozzle plate 3 according to the embodiment, when the annular projection (swage projection) 41 is plastically deformed by a swage tool (not illustrated) so as to fall radially inward, since the six spring action parts 16 are fixed to the front end surface 10 of the valve body 5 in the state in which the spring action parts 16 are elastically deformed by the annular projection 41, the force pushing the nozzle hole formation part 18 of the nozzle plate 3 against the front end surface 10 of the valve body 5 is larger than in the attachment structure of the nozzle plate 3 according to the sixth embodiment.

In the attachment structure of the nozzle plate 3 according to the embodiment, effects similar to those in the attachment structure of the nozzle plate 3 according to the sixth embodiment can be obtained.

Ninth Embodiment (Fuel Injection Device)

Figure 22:
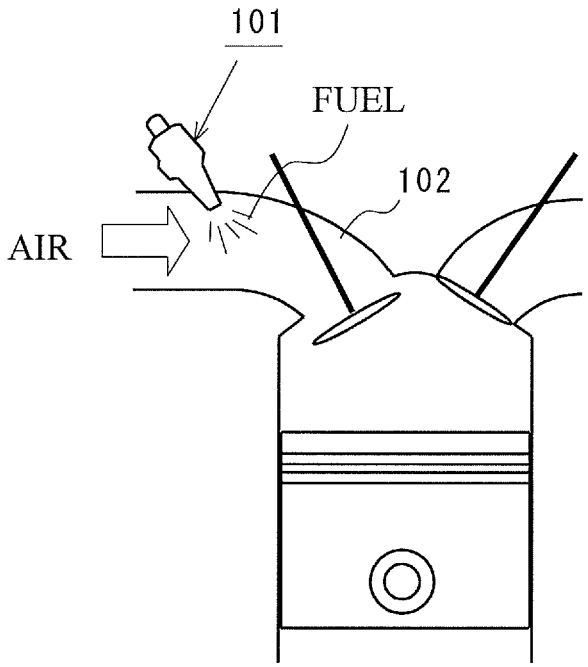
FIG. 22 schematically illustrates the use state of another fuel injection device.

FIG. 22 schematically illustrates the use state of a fuel injection device 101 (see FIG. 23). As illustrated in FIG. 22, the fuel injection device 101 of port injection type is installed at an intermediate point on an intake air pipe 102 of the engine, injects fuel into the intake air pipe 102, mixes air introduced to the intake air pipe 102 and the fuel, and generates a combustible gas mixture.

Figure 23A:
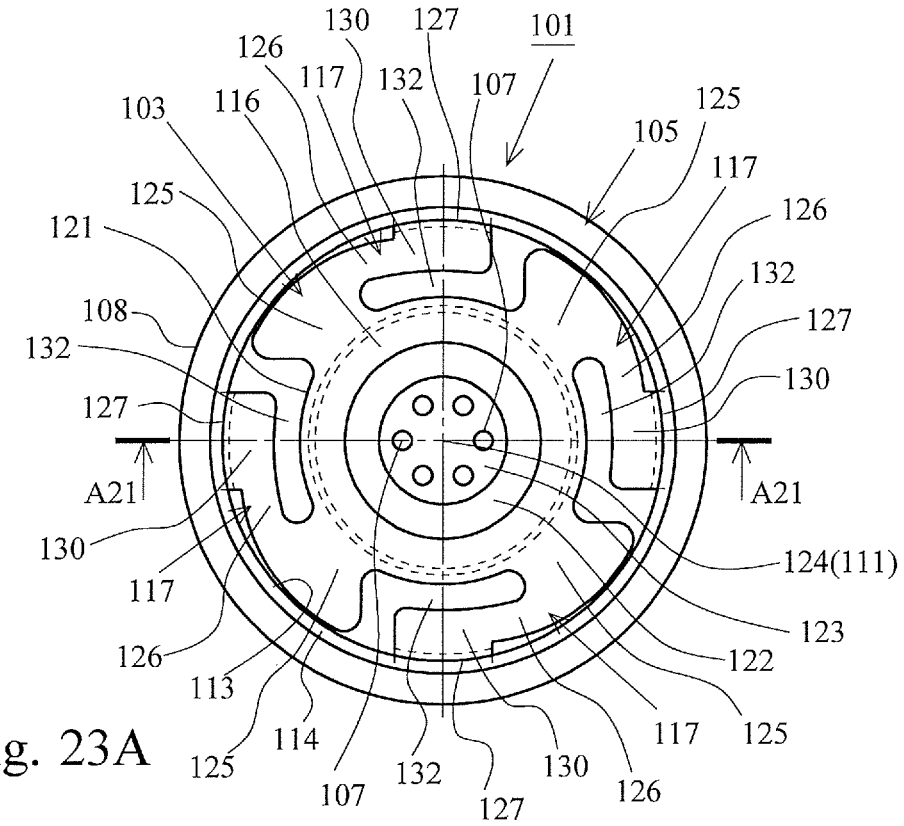
FIGS. 23A-23B illustrate an attachment structure of a nozzle plate according to a ninth embodiment of the invention. In particular.
Figure 23B:
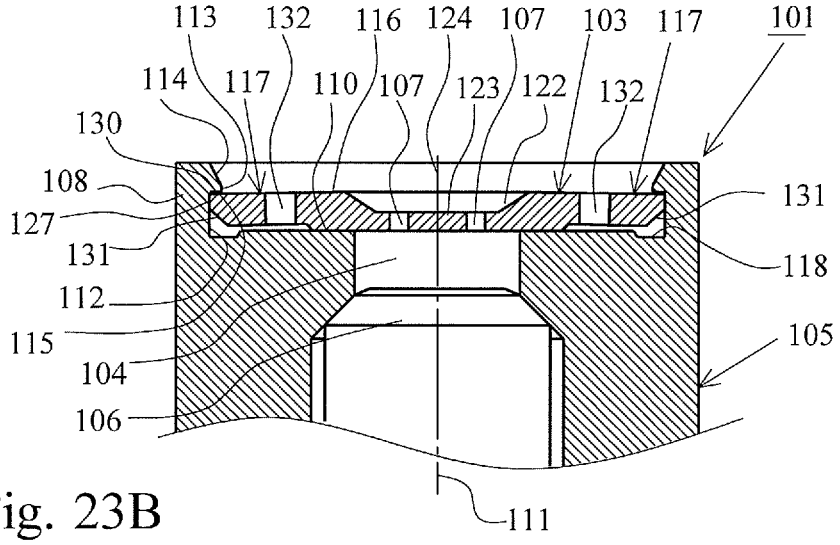

FIGS. 23A and 23B illustrate the front end side of the fuel injection device 101 to which a fuel injection device nozzle plate 103 (abbreviated below as the nozzle plate) has been attached.

As illustrated in FIGS. 23A and 23B, in the fuel injection device 101, the nozzle plate 103 of synthetic resin is attached to the front end side of a valve body 105 of metal in which a fuel injection port 104 is formed. The fuel injection device 101 has a needle valve 106 opened or closed by a solenoid (not illustrated). When the needle valve 106 is opened, fuel in the valve body 105 is injected from the fuel injection port 104, and the fuel injected from the fuel injection port 104 is injected externally via nozzle holes 107 of the nozzle plate 103. The nozzle plate 103 is injection-molded using synthetic resin such as PPS, PEEK, POM, PA, PES, PEI, or LCP.

(Attachment Structure of Nozzle Plate)

The attachment structure of the nozzle plate 103 according to the embodiment will be described with reference to FIGS. 23A to 25C.

As illustrated in FIGS. 23A to 24C, the valve body 105 is circular in front view and has a nozzle plate accommodation part 108 for accommodating the nozzle plate 103 on the front end side and the nozzle plate 103 accommodated in the nozzle plate accommodation part 108 is supported by a front end surface 110 (nozzle plate supporting part) of the valve body 105.

Figure 24A:
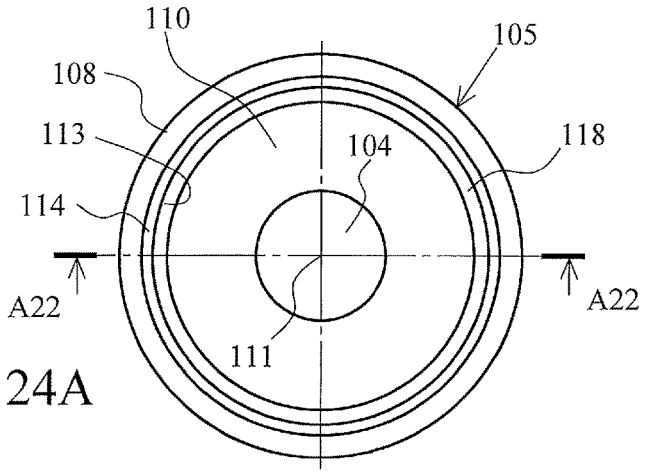
FIGS. 24A-24C illustrate a valve body according to the ninth embodiment of the invention. In particular.
Figure 24B:
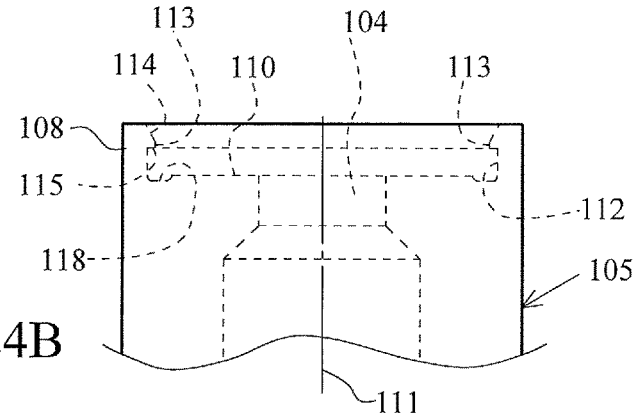
Figure 24C:
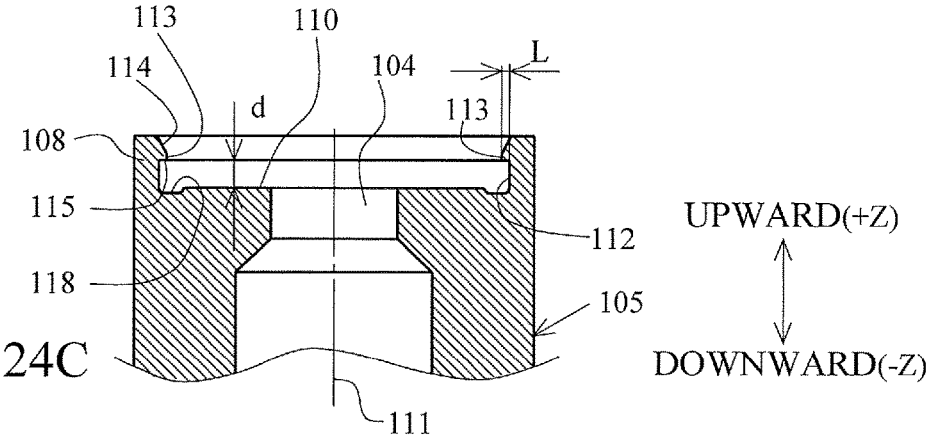

As illustrated in FIGS. 23A to 24C, the nozzle plate accommodation part 108 is formed cylindrically along (about a central axis 111 of the valve body 105) the outer peripheral edge of the front end surface 110 of the valve body 105 and a removal prevention projection 113 (nozzle plate fixation part) is formed on the part of an inner peripheral surface 112 close to the opening end. The removal prevention projection 113 is formed annularly along the inner peripheral surface 112 of the nozzle plate accommodation part 108 and has a tapered surface 114 having an inner diameter reducing from the opening end of the nozzle plate accommodation part 108 to the inside of the nozzle plate accommodation part 108 along the central axis 111 of the valve body 105. The tapered surface 114 of the removal prevention projection 113 functions as a guide surface for smoothly pushing the nozzle plate 103 into the nozzle plate accommodation part 108. In addition, as illustrated in FIGS. 24C and 25B, a dimension d along the central axis 111 between a lower surface 115 of the removal prevention projection 113 and the front end surface 110 of the valve body 105 is smaller than a plate thickness t of a nozzle hole formation part 116 of the nozzle plate 103 and larger than a plate thickness (t−h) of a spring action part 117.

As illustrated in FIGS. 23A to 24C, the front end surface 110 of the valve body 105 has, along the inner peripheral surface 112 at the root of the nozzle plate accommodation part 108, a spring action part relief groove 118 enabling the spring action part 117 of the nozzle plate 103 having been bent by the removal prevention projection 113 to be further bent. The spring action part relief groove 118 is annular as seen from the front of the valve body 105, has a groove width sufficiently larger than the projection height (amount of radially inward projection) L of the removal prevention projection 113, and has a groove depth at which the spring action part 117 bent by the removal prevention projection 113 does not make contact with the groove bottom.

As illustrated in FIGS. 23A to 25C, the nozzle plate 103 is a plate to be accommodated in the nozzle plate accommodation part 108 on the front end side of the valve body 105 and has an outside dimension larger than the inner diameter of the inner peripheral surface 112 of the nozzle plate accommodation part 108 and a back surface 120 of the nozzle hole formation part 116 makes contact with the front end surface 110 (nozzle plate supporting part) of the valve body 105. The nozzle plate 103 includes the nozzle hole formation part 116 in which the plurality of nozzle holes 107 are formed, a connection plate part 121 formed along the outer peripheral edge of the nozzle hole formation part 116, and the cantilever-shaped spring action parts 117 formed in four positions at regular intervals along the outer peripheral direction of the connection plate part 121.

As illustrated in FIGS. 23A to 25C, the nozzle hole formation part 116 is substantially discoid so as to face the fuel injection port 104 of the valve body 105 when the nozzle plate 103 is accommodated in the nozzle plate accommodation part 108 of the valve body 105 and has a mortar-shaped (inverted-cone-shaped) recessed portion 122 in the central part. A bottom wall 123 of the recessed portion 122 of the nozzle hole formation part 116 is provided with a plurality of nozzle holes 107. The plurality of nozzle holes 107 are formed at regular intervals about the center 124 (the center 124 of the nozzle plate 103) of the recessed portion 122 and atomize the fuel injected from the fuel injection port 104 of the valve body 105. Although the nozzle holes 107 are formed in six positions at regular intervals in the nozzle hole formation part 116 in the embodiment, the invention is not limited to the embodiment and a required number of nozzle holes 107 are formed depending on the use condition or the like. In addition, although the plurality of nozzle holes 107 are formed at regular intervals in the aspect, the invention is not limited to the aspect and the plurality of nozzle holes 107 may be formed at irregular intervals in the nozzle hole formation part 116.

As illustrated in FIGS. 23A to 25C, the connection plate part 121 is a part of the nozzle plate 103 formed annularly along the outer peripheral edge of the nozzle hole formation part 116. The connection plate part 121 is formed so as to be recessed by the step dimension h from the back surface 120 of the nozzle hole formation part 116 and has the same thickness as a base end portion 125 of the spring action part 117.

Figure 25A:
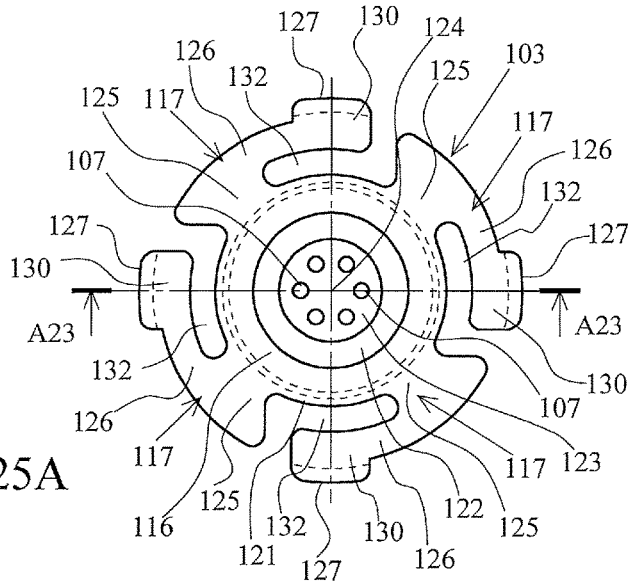
FIGS. 25A-25C illustrate the nozzle plate according to the ninth embodiment of the invention. In particular.
Figure 25B:
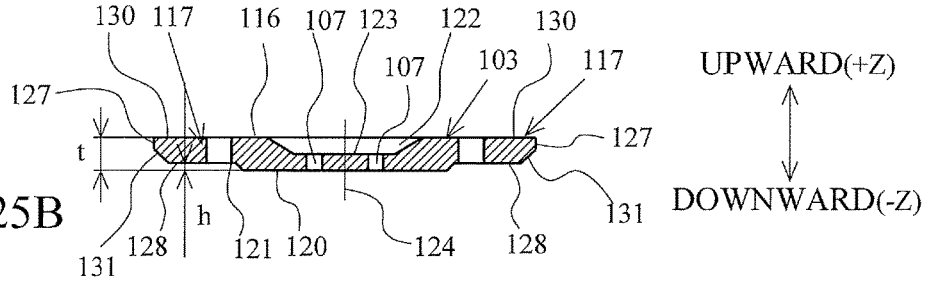
Figure 25C:
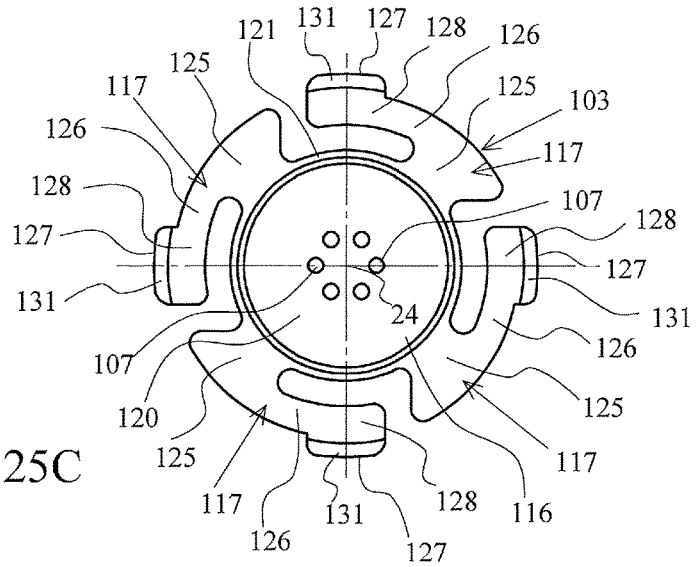
Figure 26A:
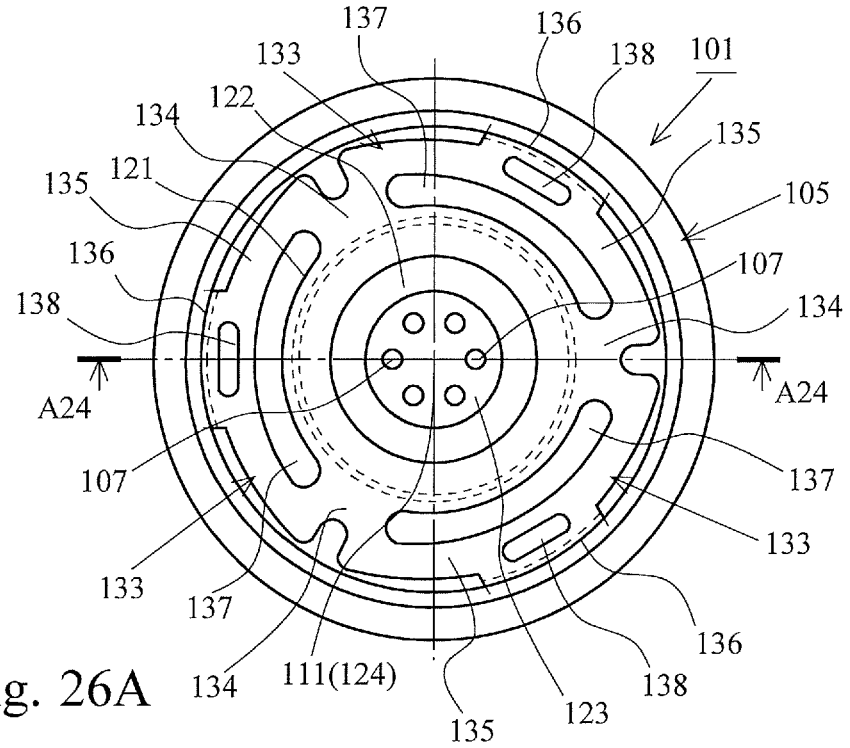
FIGS. 26A-26B illustrate an attachment structure of a nozzle plate according to a tenth embodiment of the invention. In particular.
Figure 26B:
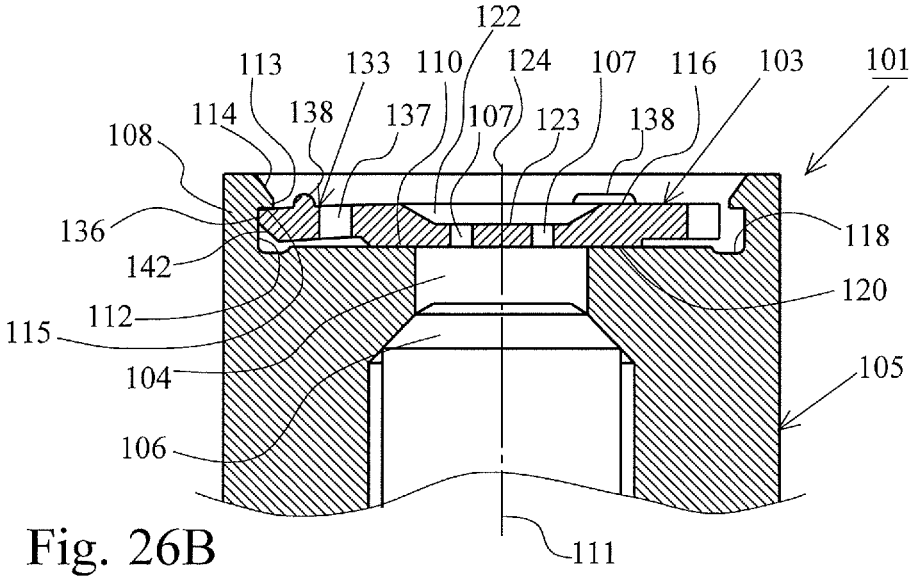
Figure 27A:
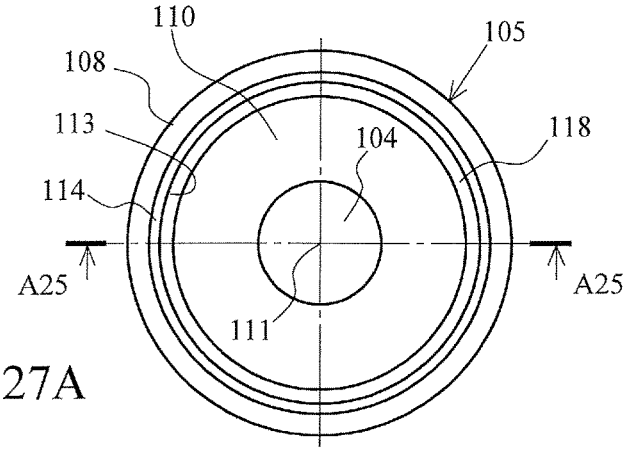
FIGS. 27A-27C illustrate a valve body according to the tenth embodiment of the invention. In particular.
Figure 27B:
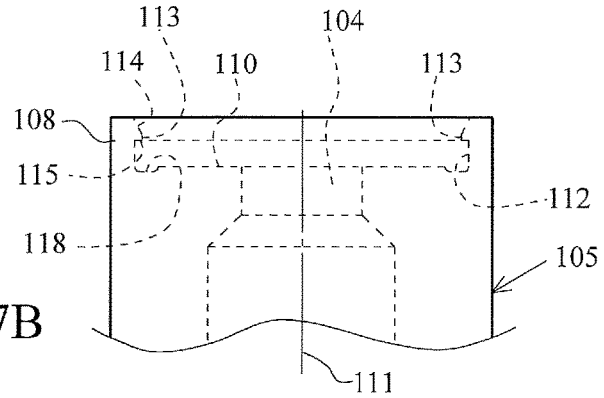
Figure 27C:
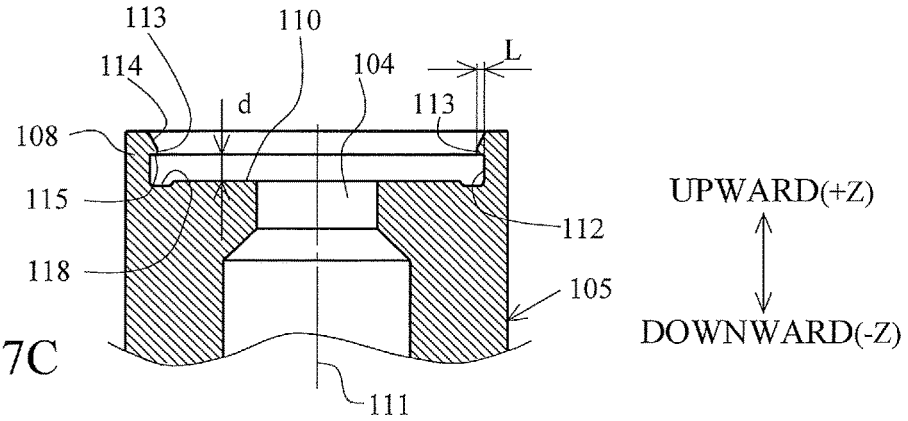
Figure 28A:
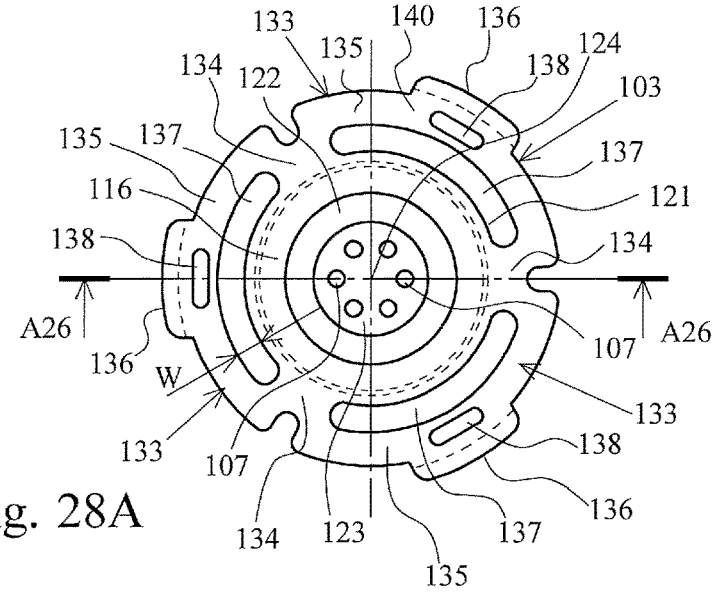
FIGS. 28A-28C illustrate the nozzle plate according to the tenth embodiment of the invention. In particular.
Figure 28B:
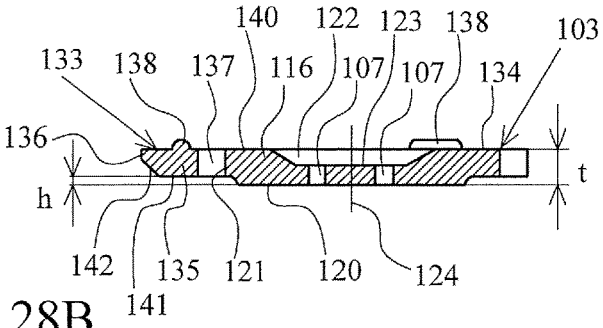
Figure 28C:
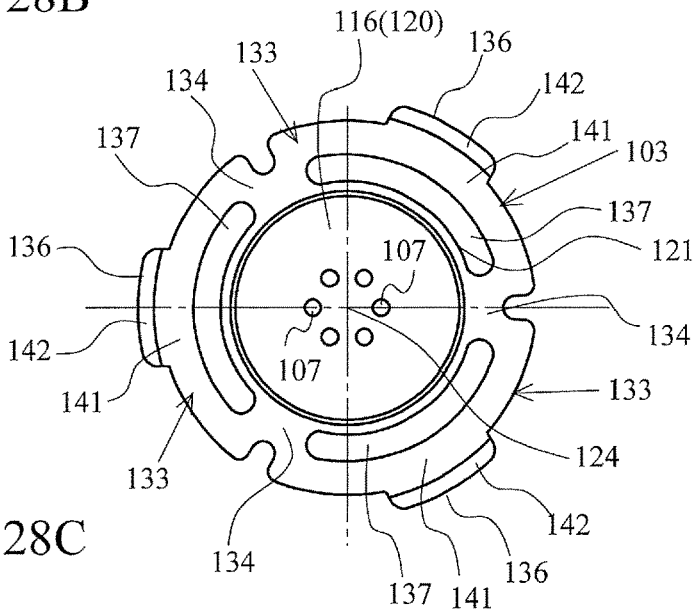

As illustrated in FIGS. 23A and 25A, the spring action part 117 includes the base end portion 125 extending radially outward of the connection plate part 121, a cantilever portion 126 extending along the circumferential direction of the connection plate part 121 from the base end portion 125, and an abutment portion 127 projecting radially outward of the front end side of the cantilever portion 126. The entire spring action part 117 is thinner than the nozzle hole formation part 116 so that a back surface 128 thereof is recessed by the step dimension h from the back surface 120 of the nozzle hole formation part 116. The base end portion 125 of the spring action part 117 has a bending rigidity larger than in the cantilever portion 126 and is not easily elastically deformed as compared with the cantilever portion 126. When the abutment portion 127 is pushed radially inward (toward the center), the cantilever portion 126 of the spring action part 117 is bent (deformed so as to reduce the diameter) radially inward using the base end portion 125 as a fulcrum. In addition, when the abutment portion 127 is pushed downward (−Z direction) in FIG. 25B, the cantilever portion 126 of the spring action part 117 is bent (elastically deformed) downward (−Z direction) in FIG. 25B using the base end portion 125 as a fulcrum. In addition, in the abutment portion 127 of the spring action part 117, when the nozzle plate 103 is accommodated in the nozzle plate accommodation part 108, an upper surface 130 in FIG. 25B makes contact with the removal prevention projection 113 and is pushed downward (−Z direction) and makes contact with the inner peripheral surface 112 of the nozzle plate accommodation part 108 and is pushed radially inward (toward the center). In addition, in the abutment portion 127 of the spring action part 117, an inclined plane 131 is formed on a lower surface disposed at radially outward end and, when the inclined plane 131 slides and moves (moves downward) while being guided to the tapered surface 114 of the removal prevention projection 113, the cantilever portion 126 of the spring action part 117 is deformed (elastically deformed) so as to reduce the diameter. In addition, there is a clearance 132 larger than a projection height L of the removal prevention projection 113 of the nozzle plate accommodation part 108 between the cantilever portion 126 of the spring action part 117 and the connection plate part 121. As a result, the spring action part 117 can be deformed so as to reduce the diameter by the clearance 132 between the cantilever portion 126 and the connection plate part 121.

When the nozzle plate 103 formed as described above is pushed into (accommodated in) the nozzle plate accommodation part 108 of the valve body 105, the inclined plane 131 of the abutment portion 127 of the spring action part 117 slides and moves while being guided by the tapered surface 114 of the removal prevention projection 113 of the nozzle plate accommodation part 108, the cantilever portion 126 of the spring action part 117 is deformed (elastically deformed) so as to reduce the diameter, and the nozzle plate 103 can pass radially inward of the removal prevention projection 113 of the nozzle plate accommodation part 108. After the nozzle hole formation part 116 of the nozzle plate 103 is seated on the front end surface 110 of the valve body 105, if the abutment portion 127 of the spring action part 117 (or the front end side of the cantilever portion 126) is further pushed, the cantilever portion 126 of the spring action part 117 is bent (elastically deformed) so as to reduce the space with respect to the front end surface 110 of the valve body 105, the abutment portion 127 of the spring action part 117 is accommodated in the space between the removal prevention projection 113 and the front end surface 110 of the valve body 105, the cantilever portion 126 of the spring action part 117 is elastically restored in the diameter increasing direction, and the abutment portion 127 of the spring action part 117 abuts against the inner peripheral surface 112 of the nozzle plate accommodation part 108 by the elastic force of the cantilever portion 126 of the spring action part 117. Since the elastic forces of the spring action parts 117 in the four positions are the same and intersect at the center 124 at this time, the nozzle plate 103 is positioned (aligned) with respect to the valve body 105 so that the center 124 of the nozzle plate 103 is aligned with the central axis 111 of the valve body 105. In addition, since the abutment portion 127 of the spring action part 117 is pushed by the removal prevention projection 113 and the cantilever portion 126 of the spring action part 117 is bent (elastically deformed by the amount less than the step dimension h) so as to approach the front end surface 110 of the valve body 105 at this time, the nozzle hole formation part 116 of the nozzle plate 103 is pushed against the front end surface 110 of the valve body 105 by the elastic force of the spring action part 117, and the back surface 120 of the nozzle hole formation part 116 of the nozzle plate 103 makes close contact with the front end surface 110 of the valve body 105. As a result, the fuel injected from the fuel injection port 104 is not leaked from between the nozzle hole formation part 116 of the nozzle plate 103 and the front end surface 110 of the valve body 105.

Effect of Ninth Embodiment

Figure 33:
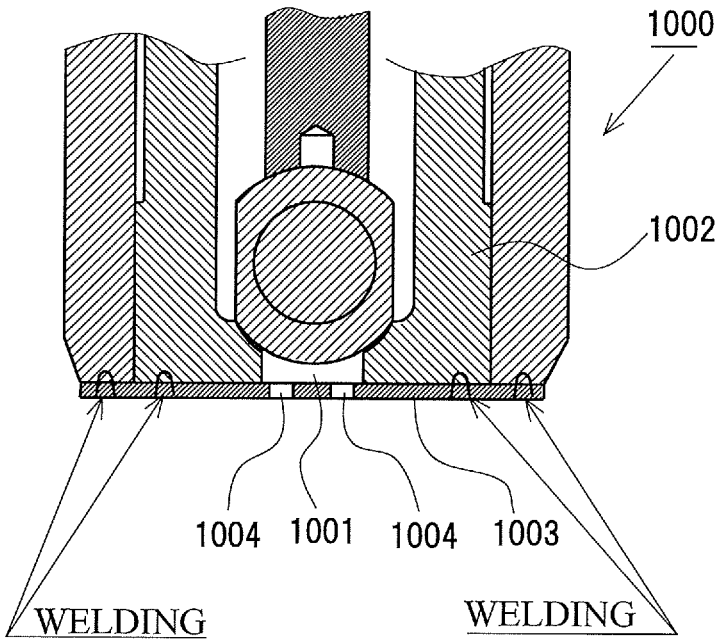
Fig. 33 (Prior Art)
FIG. 33 is a cross sectional view of the front end side of a fuel injection device illustrating a conventional attachment structure of a nozzle plate.

In the attachment structure of the nozzle plate 103 according to the embodiment, the nozzle plate 103 is fixed to the front end side of the valve body 105 only if the nozzle plate 103 is pushed into the nozzle plate accommodation part 108 of the valve body 105. Accordingly, in the attachment structure of the nozzle plate 103 according to the embodiment, the manufacturing man-hours and manufacturing cost of the fuel injection device 101 can be reduced as compared with the conventional example (see FIG. 33) in which the nozzle plate 1003 of metal is fixed to the front end of the valve body 1002 of metal by welding.

In addition, in the attachment structure of the nozzle plate 103 according to the embodiment, when the nozzle plate 103 is accommodated in the nozzle plate accommodation part 108 of the valve body 105, the spring action part 117 is fixed while being elastically deformed and the nozzle hole formation part 116 is pushed against the front end surface 110 (nozzle plate supporting part) of the valve body 105 by the elastic force of the spring action part 117. Accordingly, in the invention, the assembly error of the nozzle plate 103 and the valve body 105 can be absorbed by the elastic deformation of the spring action part 117, the difference in thermal expansion between the nozzle plate 103 and the valve body 105 can be absorbed by the elastic deformation of the spring action part 117, and the nozzle plate 103 can be surely fixed to the front end side of the valve body 105.

Although the spring action parts 117 are formed in four positions at regular intervals around the nozzle hole formation part 116 in the embodiment, the invention is not limited to the embodiment and the two or more spring action parts 117 are formed at regular intervals around the nozzle hole formation part 116. In addition, although the plurality of spring action parts 117 may be formed at irregular intervals around the nozzle hole formation part 116, the spring force (elastic force) needs to be adjusted so that the center 124 of the nozzle plate 103 can be aligned with the central axis 111 of the valve body 105.

In the ninth embodiment, when the step dimension h between the back surface 128 of the spring action part 117 and the back surface 120 of the nozzle hole formation part 116 is large and the abutment portion 127 of the spring action part 117 of the nozzle plate 103 can be pushed into the gap between the removal prevention projection 113 of the valve body 105 and the front end surface 110 without difficulty, the spring action part relief groove 118 of the front end surface 110 of the valve body 105 may be omitted.

Tenth Embodiment

FIGS. 26A to 28C illustrate an attachment structure of the nozzle plate 103 according to a tenth embodiment of the invention. In the attachment structure of the nozzle plate 103 according to the embodiment, the shape of the nozzle plate 103 is different from that in the nozzle plate 103 according to the ninth embodiment, but the remaining structure is the same as in the attachment structure of the nozzle plate 103 according to the ninth embodiment. Accordingly, the same components as in the attachment structure of the nozzle plate 103 according to the ninth embodiment are given the same reference numerals, and duplicate descriptions as in the attachment structure of the nozzle plate 103 according to the ninth embodiment are omitted.

In the embodiment, the nozzle plate 103 has spring action parts 133 formed in three positions at regular intervals along the outer periphery of the connection plate part 121. The spring action part 133 includes a pair of base end portions 134 separately disposed in the circumferential direction of the connection plate part 121, a beam portion 135 with both ends fixed so as to be connected across the base end portions 134, and an abutment portion 136 formed in the middle in the circumferential direction of the beam portion 135. In the nozzle plate 103 according to the embodiment, the plurality of nozzle holes 107 are formed in the nozzle hole formation part 116, and the connection plate part 121 is formed on the outer periphery side of the nozzle hole formation part 116 as in the nozzle plate 103 according to the ninth embodiment.

The spring action part 133 and the spring action part 133 adjacent to it share the base end portion 134, and the base end portions 134 are formed in three positions at regular intervals along the outer periphery of the connection plate part 121 so as to project radially outward from the connection plate part 121.

The beam portion 135 of the spring action part 133 is separated from the connection plate part 121 by a circumferential direction groove 137 penetrating from the front to the back of the nozzle plate 103 by a groove width dimension W. The groove width dimension W of the circumferential direction groove 137 between the both end fixed beam portion 135 and the connection plate part 121 is sufficiently larger than the projection height L of the removal prevention projection 113 (nozzle plate fixation part). The beam portion 135 is deformed (elastically deformed radially inward) so as to reduce the diameter when the abutment portion 136 is pushed radially inward and the beam portion 135 is elastically restored to the original shape when the pushing force on the abutment portion 136 is released. When the abutment portion 136 is pushed toward the front end surface 110 of the valve body 105 in the state in which the back surface 120 of the nozzle hole formation part 116 is supported by the front end surface 110 of the valve body 105, the both end fixed beam portion 135 is bent (elastically deformed) so as to approach the front end surface 110 of the valve body 105. When the pushing force on the abutment portion 136 is released, the beam portion 135 is elastically restored to the original shape. In addition, the both end fixed beam portion 135 of the spring action part 133 has an elongated pushing projection 138 extending along the circumferential direction on an upper surface 140 (surface opposite to a back surface 141 of the spring action part 133) of the circumferential direction middle portion. When the pushing projection 138 is pushed by a pushing tool (not illustrated), only the both end fixed beam portion 135 is bent by the pushing tool, and the nozzle hole formation part 116 is not deformed by the pushing tool.

The abutment portion 136 of the spring action part 133 projects radially outward from the circumferential direction central part of the both end fixed beam portion 135 and has an inclined plane 142 on the lower surface of the radially outward end. When the inclined plane 142 slides and moves (moves downward) while being guided by the tapered surface 114 of the removal prevention projection 113, the abutment portion 136 of the spring action part 133 deforms (elastically deforms) the both end fixed beam portion 135 of the spring action part 133 so as to reduce the diameter.

When the nozzle plate 103 formed as described above is pushed into (accommodated in) the nozzle plate accommodation part 108 of the valve body 105, the inclined plane 142 of the abutment portion 136 of the spring action part 133 slides and moves while being guided by the tapered surface 114 of the removal prevention projection 113 of the nozzle plate accommodation part 108, the both end fixed beam portion 135 of the spring action part 133 is deformed (elastically deformed) so as to reduce the diameter, and the nozzle plate 103 can pass radially inward of the removal prevention projection 113 of the nozzle plate accommodation part 108. After the nozzle hole formation part 116 of the nozzle plate 103 is seated on the front end surface 110 of the valve body 105, if the pushing projection 138 formed in the both end fixed beam portion 135 of the spring action part 133 is further pushed, the both end fixed beam portion 135 of the spring action part 133 is bent (elastically deformed) so that the front end surface 110 of the valve body 105 reduces the space with respect to the front end surface 110 of the valve body 105, the abutment portion 136 of the spring action part 133 is accommodated in the space between the removal prevention projection 113 and the front end surface 110 of the valve body 105, the both end fixed beam portion 135 of the spring action part 133 is elastically restored in the diameter increasing direction, and the abutment portion 136 of the spring action part 133 abuts against the inner peripheral surface 112 of the nozzle plate accommodation part 108 by the elastic force of the both end fixed beam portion 135 of the spring action part 133. Since the elastic forces of the spring action parts 133 in the three positions are the same and intersect at the center 124 at this time, the nozzle plate 103 is positioned (aligned) with respect to the valve body 105 so that the center 124 of the nozzle plate 103 is aligned with the central axis 111 of the valve body 105. In addition, since the abutment portion 136 of the spring action part 133 is pushed by the removal prevention projection 113 and the both end fixed beam portion 135 of the spring action part 133 is bent (elastically deformed by the amount less than the step dimension h between the back surface 120 of the nozzle hole formation part 116 and the back surface 141 of the spring action part 133) so as to approach the front end surface 110 of the valve body 105 at this time, the nozzle hole formation part 116 of the nozzle plate 103 is pushed against the front end surface 110 of the valve body 105 by the elastic force of the spring action part 133, and the back surface 120 of the nozzle hole formation part 116 of the nozzle plate 103 makes close contact with the front end surface 110 of the valve body 105. As a result, the fuel injected from the fuel injection port 104 is not leaked from between the nozzle hole formation part 116 of the nozzle plate 103 and the front end surface 110 of the valve body 105.

In the attachment structure of the nozzle plate 103 according to the embodiment, effects similar to those in the attachment structure of the nozzle plate 103 according to the ninth embodiment can be obtained.

Although the nozzle plate 103 has the pushing projection 138 on the both end fixed beam portion 135 of the spring action part 133 in the embodiment, the pushing projection 138 may be omitted only when using a pushing tool capable of pushing at least one of the both end fixed beam portion 135 and the abutment portion 136.

[Modification 1]

Figure 29:
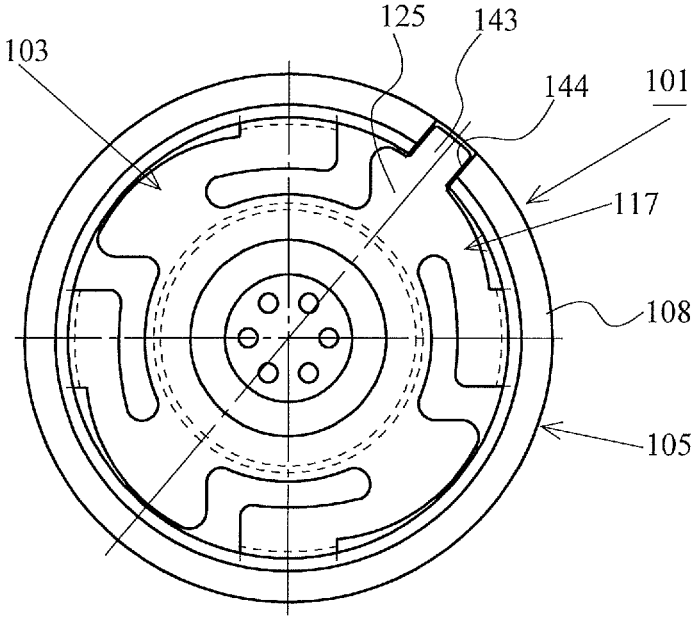
FIG. 29 is a front view of the front end side of the fuel injection device illustrating an attachment structure of a nozzle plate according to a modification of the ninth embodiment of the invention.

FIG. 29 is a front view of the front end side of the fuel injection device 101 illustrating an attachment structure of the nozzle plate 103 according to a modification of the ninth embodiment of the invention.

As illustrated in FIG. 29, in the spring action part 117 of the nozzle plate 103, the base end portion 125, which is not easily deformed, has a rotation prevention projection 143 projecting radially outward. In addition, the nozzle plate accommodation part 108 of the valve body 105 for accommodating the nozzle plate 103 is provided with a rotation prevention groove 144 engaging the rotation prevention projection 143 of the nozzle plate 103.

In addition, in the attachment structure of the nozzle plate 103 according to the modification having such a structure, the rotation prevention projection 143 of the nozzle plate 103 engages with the rotation prevention groove 144 of the nozzle plate accommodation part 108, so that the nozzle plate 103 can be positioned with respect to the circumferential direction on the front end side of the valve body 105.

[Modification 2]

Figure 30A:
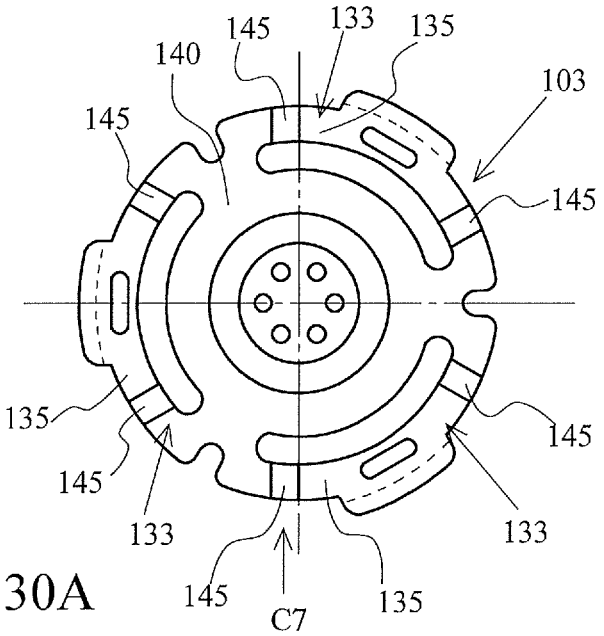
FIGS. 30A-30B illustrate a nozzle plate according to a modification of the tenth embodiment of the invention. In particular.
Figure 30B:
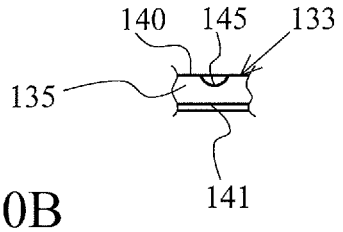

FIGS. 30A and 30B illustrate the nozzle plate 103 according to a modification of the tenth embodiment of the invention.

As illustrated in FIG. 30, the nozzle plate 103 according to the modification has a notch groove 145 extending radially on the upper surface 140 opposite to the back surface 141 of the spring action part 133 in the vicinity of both end parts (in the vicinity of the base end portion) of the both end fixed beam portion 135 of the spring action part 133. The notch groove 145 formed in the both end fixed beam portion 135 makes the both end fixed beam portion 135 easily bendable and the bending rigidity in the vicinity of both ends of the both end fixed beam portion 135 is smaller than that of the other part of the both end fixed beam portion 135. The notch groove 145 of the both end fixed beam portion 135 has an arc-shaped cross section as seen from the direction orthogonal to the groove to prevent stress from concentrating in the vicinity of both ends of the both end fixed beam portion 135.

[Modification 3]

Figure 31:
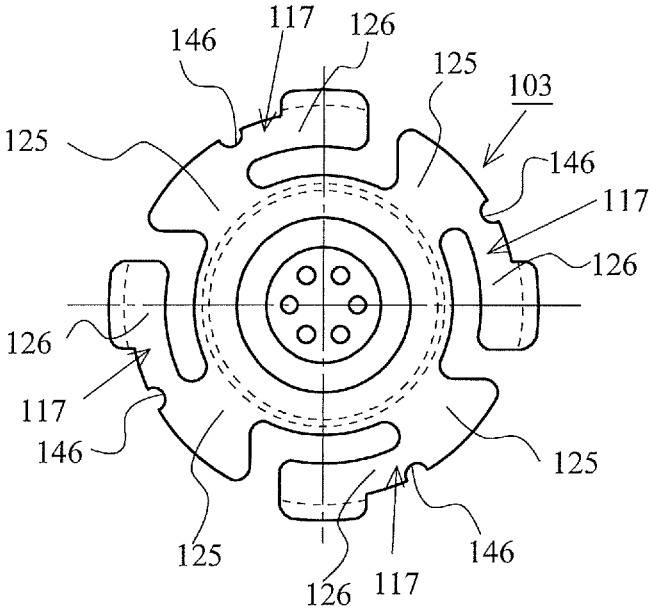
FIG. 31 illustrates a nozzle plate according to a modification of the ninth embodiment of the invention.

FIG. 31 illustrates the nozzle plate 103 according to a modification of the ninth embodiment of the invention.

As illustrated in FIG. 31, the nozzle plate 103 according to the modification has a notch groove 146 for making the cantilever portion 126 of the spring action part 117 elastically deformable (bendable) easily in the end part of the cantilever portion 126 close to the base end portion 125 so that the bending rigidity of the end part of the cantilever portion 126 close to the base end portion 125 is smaller than that of the other part of the cantilever portion 126. The notch groove 146 extends in the plate thickness direction of the cantilever portion 126 and has an arc-shaped cross section in the direction orthogonal to the groove to prevent stress from concentrating on the part of the cantilever portion 126 close to the base end portion 125.

[Modification 4]

Figure 32:
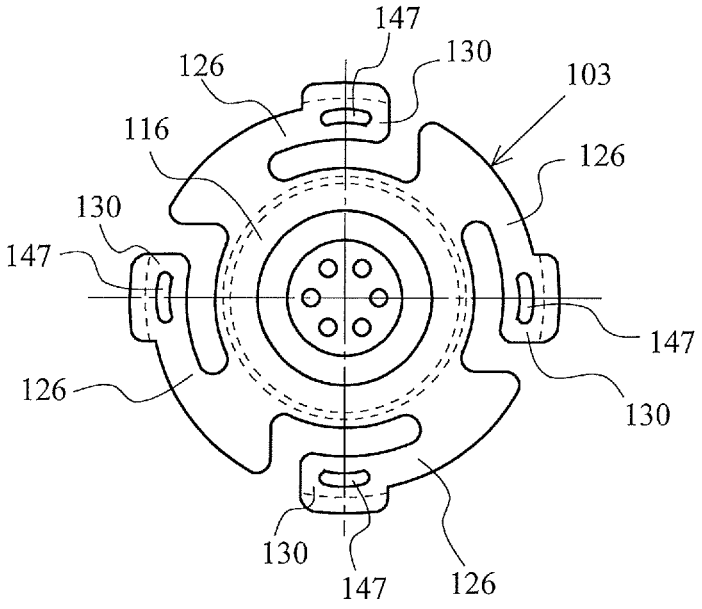
FIG. 32 illustrates a nozzle plate according to another modification of the ninth embodiment of the invention.

FIG. 32 illustrates the nozzle plate 103 according to another modification of the ninth embodiment of the invention.

As illustrated in FIG. 32, the nozzle plate 103 according to the modification has a pushing projection 147 on the front end side upper surface 130 (the surface opposite to the back surface 128 of the spring action part 117 (see FIG. 25A)) of the cantilever portion 126. By pushing the pushing projection 147 using a pushing tool (not illustrated), only the cantilever portion 126 can be bent (elastically deformed) and the nozzle hole formation part 116 is prevented from being deformed by the pushing tool. In the nozzle plate 111, instead of forming the pushing projection 147 on the cantilever portion 126, the upper surface of the part (for example, the nozzle hole formation part 116) preferably not to be pushed by the pushing tool may be recessed from the upper surface of the cantilever portion 126.

REFERENCE SIGNS LIST

1: fuel injection device
3: nozzle plate (fuel injection device nozzle plate)
4: fuel injection port
5: valve body
7: nozzle hole
8: nozzle plate accommodation part
10: front end surface (nozzle plate supporting part)
11: central axis
15, 32, 37: swage projection (swage part as nozzle plate fixation part)
16: spring action part
18: nozzle hole formation part
22: center
41: annular projection (nozzle plate fixation part)
101: fuel injection device
103: nozzle plate (fuel injection device nozzle plate)
104: fuel injection port
105: valve body
107: nozzle hole
108: nozzle plate accommodation part

110: front end surface (nozzle plate supporting part)
111: central axis
112: inner peripheral surface
113: removal prevention projection (nozzle plate fixation part)
116: nozzle hole formation part
117, 133: spring action part
124: center

What is claimed is:

1. A fuel injection nozzle plate attachment structure comprising:

a fuel injection device nozzle plate formed of synthetic resin and having a nozzle hole for atomizing and injecting fuel flowing from a fuel injection port of a fuel injection device; and a metal valve body having the fuel injection port on a front end side, a cylindrical nozzle plate accommodation part accommodating the fuel injection device nozzle plate, and a nozzle plate supporting part supporting the fuel injection device nozzle plate accommodated in the nozzle plate accommodation part using the front end side on which the fuel injection port is formed, wherein the nozzle plate accommodation part has, on a part of an inner peripheral surface close to an opening end, a removal prevention projection configured to prevent the fuel injection device nozzle plate accommodated in the nozzle plate accommodation part from being removed so that the removal prevention projection is hooked on the fuel injection device nozzle plate, wherein the fuel injection device nozzle plate has a nozzle hole formation part in which the nozzle hole is formed, and a plurality of spring action parts formed radially outward of the nozzle hole formation part, wherein each of the spring action parts is configured to be:

elastically deformed in a diameter reducing direction by the removal prevention projection when the fuel injection nozzle plate is accommodated in the nozzle plate accommodation part to enable the fuel injection nozzle plate to pass radially inward of the removal prevention projection, and elastically restored in a diameter increasing direction when the fuel injection nozzle plate is accommodated in the nozzle plate accommodation part and makes contact with an inner peripheral surface of the nozzle plate accommodation part to thereby align a center of the fuel injection device nozzle plate with a central axis of the valve body and be bent by the removal prevention projection so as to push the nozzle hole formation part against the nozzle plate supporting part.

2. The attachment structure according to claim 1, wherein the nozzle plate supporting part has a spring action part relief groove enabling the spring action part bent by the removal prevention projection to be further bent.

3. The attachment structure according to claim 1, wherein the spring action part is configured so as not to make contact with the nozzle plate supporting part even when the spring action part is bent by the removal prevention projection.

4. The attachment structure according to claim 1, wherein the fuel injection nozzle plate has a rotation prevention projection engaging with a rotation prevention groove formed in the nozzle plate accommodation part.

5. The attachment structure according to claim 2, wherein the fuel injection nozzle plate has a rotation prevention projection engaging with a rotation prevention groove formed in the nozzle plate accommodation part.

6. The attachment structure according to claim 3, wherein the fuel injection nozzle plate has a rotation prevention projection engaging with a rotation prevention groove formed in the nozzle plate accommodation part.

* * * * *